US008776891B2

(12) United States Patent
Donald et al.

(10) Patent No.: US 8,776,891 B2
(45) Date of Patent: Jul. 15, 2014

(54) CONNECTION SYSTEM FOR SUBSEA FLOW INTERFACE EQUIPMENT

(75) Inventors: Ian Donald, Aberdeenshire (GB); John Reid, Dundee (GB); Alan Crawford, Aberdeen (GB); Paul W. White, Banchory (GB)

(73) Assignee: Cameron Systems (Ireland) Limited, Longford (IE)

( * ) Notice: Subject to any disclaimer, the term of this patent is extended or adjusted under 35 U.S.C. 154(b) by 65 days.

(21) Appl. No.: 13/267,039

(22) Filed: Oct. 6, 2011
(Under 37 CFR 1.47)

(65) Prior Publication Data

US 2012/0273214 A1 Nov. 1, 2012

Related U.S. Application Data

(62) Division of application No. 10/590,563, filed as application No. PCT/GB2005/000725 on Feb. 25, 2005, now Pat. No. 8,066,076.

(60) Provisional application No. 60/548,727, filed on Feb. 26, 2004.

(51) Int. Cl.
*E21B 43/00* (2006.01)

(52) U.S. Cl.
USPC ..... 166/344; 166/360; 166/368; 166/90.1

(58) Field of Classification Search
USPC ..... 166/344, 338, 347, 351, 360, 368, 263, 166/378–380, 85.1, 90.1; 285/123.1
See application file for complete search history.

(56) References Cited

U.S. PATENT DOCUMENTS

| | | | |
|---|---|---|---|
| 1,758,376 | A | 5/1930 | Sawyer |
| 1,944,573 | A | 1/1934 | Williams et al. |
| 1,944,840 | A | 1/1934 | Humason |
| 1,994,840 | A | 3/1935 | Thoen |
| 2,132,199 | A | 10/1938 | Yancey |
| 2,233,077 | A | 2/1941 | Gillespie et al. |
| 2,276,883 | A | 3/1942 | Schon et al. |
| 2,412,765 | A | 12/1946 | Buddrus et al. |
| 2,790,500 | A | 4/1957 | Jones |
| 2,893,435 | A | 7/1959 | Eichenberg |
| 2,962,356 | A | 11/1960 | Johns |
| 3,101,118 | A | 8/1963 | Culver et al. |

(Continued)

FOREIGN PATENT DOCUMENTS

| | | |
|---|---|---|
| AU | 498216 | 4/1999 |
| BR | 10415841 | 3/2007 |

(Continued)

OTHER PUBLICATIONS

Examination Report dated Jun. 30, 2011; European Application No. 10161116.8 (2p.).

(Continued)

*Primary Examiner* — Matthew Buck
(74) *Attorney, Agent, or Firm* — Conley Rose, P.C.

(57) ABSTRACT

A connection system for connecting flow interface equipment to a subsea manifold is disclosed. The connection system relates particularly to a connection apparatus adapted to land a conduit means on a subsea manifold in a first stage of the connection and to connect a conduit means of the connection apparatus to a choke body of the manifold in a second stage of the connection.

12 Claims, 12 Drawing Sheets

(56) References Cited

U.S. PATENT DOCUMENTS 3,163,224 A 12/1964 Haeber et al.
3,358,753 A 12/1967 Haeber
3,378,066 A 4/1968 Otteman et al.
3,593,808 A 7/1971 Nelson
3,595,311 A 7/1971 Harbonn et al.
3,603,409 A 9/1971 Watkins
3,608,631 A 9/1971 Sizer et al.
3,688,840 A 9/1972 Curington et al.
3,705,626 A 12/1972 Glenn, Jr. et al.
3,710,859 A 1/1973 Hanes et al.
3,753,257 A 8/1973 Arnold
3,777,812 A 12/1973 Burkhardt et al.
3,820,558 A 6/1974 Mueller
3,834,460 A 9/1974 Brun et al.
3,953,982 A 5/1976 Pennock
3,957,079 A 5/1976 Whiteman
4,042,033 A 8/1977 Holland et al.
4,046,191 A 9/1977 Neath
4,046,192 A 9/1977 Darnborough
4,095,649 A 6/1978 Chateau et al.
4,099,583 A 7/1978 Maus
4,102,401 A 7/1978 Erbstoesser
4,105,068 A 8/1978 Tam
4,120,362 A 10/1978 Chateau et al.
4,134,456 A * 1/1979 Ball ..... 166/356
4,190,120 A 2/1980 Regan
4,210,208 A 7/1980 Shanks
4,223,728 A 9/1980 Pegg
4,260,022 A 4/1981 Van Bilderbeek
4,274,664 A 6/1981 Thominet
4,291,772 A 9/1981 Beynet
4,294,471 A 10/1981 Van Bilderbeek
4,347,899 A 9/1982 Weeter
4,401,164 A 8/1983 Baugh
4,403,658 A 9/1983 Watkins
4,405,016 A 9/1983 Best
4,444,275 A 4/1984 Beynet et al.
4,457,489 A 7/1984 Gilmore
4,478,287 A 10/1984 Hynes et al.
4,502,534 A 3/1985 Roche et al.
4,503,878 A 3/1985 Taylor
4,509,599 A 4/1985 Chenoweth et al.
4,572,298 A 2/1986 Weston
4,589,493 A 5/1986 Kelly et al.
4,607,701 A 8/1986 Gunderson
4,610,570 A 9/1986 Brockway
4,626,135 A 12/1986 Roche
4,629,003 A 12/1986 Baugh
4,630,681 A 12/1986 Iwamoto
4,646,844 A 3/1987 Roche et al.
4,648,629 A 3/1987 Baugh
4,695,190 A 9/1987 Best et al.
4,702,320 A 10/1987 Gano et al.
4,721,163 A 1/1988 Davis
4,749,046 A 6/1988 Gano
4,756,368 A 7/1988 Ikuta et al.
4,813,495 A 3/1989 Leach
4,820,083 A 4/1989 Hall
4,830,111 A 5/1989 Jenkins et al.
4,832,124 A * 5/1989 Rayson ..... 166/339
4,848,471 A 7/1989 Bencze et al.
4,848,473 A 7/1989 Lochte
4,848,475 A 7/1989 Dean et al.
4,874,008 A 10/1989 Lawson
4,896,725 A 1/1990 Parker et al.
4,899,822 A 2/1990 Daeschler et al.
4,911,240 A 3/1990 Haney et al.
4,919,207 A 4/1990 Ikuta et al.
4,926,898 A 5/1990 Sampey
4,972,904 A 11/1990 Godare
5,010,956 A 4/1991 Bednar
5,025,865 A 6/1991 Caldwell
5,044,672 A 9/1991 Skeels
5,069,286 A 12/1991 Roensch
5,074,519 A 12/1991 Pettus
5,085,277 A 2/1992 Hopper
5,143,158 A 9/1992 Watkins
5,163,782 A * 11/1992 Paulo ..... 405/169
5,201,491 A 4/1993 Domangue
5,213,162 A 5/1993 Iato
5,248,166 A 9/1993 Wilkins
5,255,745 A * 10/1993 Czyrek ..... 166/347
5,280,766 A 1/1994 Mohn
5,295,534 A 3/1994 Porter
5,299,641 A * 4/1994 Paulo et al. ..... 166/341
5,310,006 A * 5/1994 Freitas et al. ..... 166/339
5,398,761 A 3/1995 Reynolds
5,456,313 A 10/1995 Hopper
5,462,361 A 10/1995 Sato
5,492,436 A 2/1996 Suksumake
5,526,882 A 6/1996 Parks
5,535,826 A 7/1996 Brown
5,544,707 A 8/1996 Hopper
5,649,594 A * 7/1997 Flak et al. ..... 166/277
5,678,460 A 10/1997 Walkowc
5,719,481 A 2/1998 Mo
5,730,551 A 3/1998 Skeels
5,807,027 A 9/1998 Oestergaar
5,868,204 A 2/1999 Pritchett et al.
5,884,706 A 3/1999 Edwards
5,927,405 A 7/1999 Monjure
5,944,152 A 8/1999 Lindsay
5,971,077 A * 10/1999 Lilley ..... 166/368
5,988,282 A 11/1999 Jennings et al.
5,992,526 A 11/1999 Cunningham et al.
5,992,527 A 11/1999 Garnham et al.
6,039,119 A 3/2000 Hopper et al.
6,050,339 A 4/2000 Milberger
6,053,252 A 4/2000 Edwards
6,076,605 A * 6/2000 Lilley et al. ..... 166/368
6,098,715 A 8/2000 Seixas
6,109,352 A 8/2000 Edwards
6,116,784 A 9/2000 Brotz
6,123,312 A 9/2000 Dai
6,138,774 A 10/2000 Bourgoyne, Jr.
6,145,596 A 11/2000 Dallas
6,182,761 B1 2/2001 Bednar
6,186,239 B1 2/2001 Monjure
6,209,650 B1 4/2001 Ingebrigtsen et al.
6,227,300 B1 5/2001 Cunningham
6,289,992 B1 9/2001 Monjure
6,296,453 B1 10/2001 Layman
6,321,843 B2 11/2001 Baker
6,352,114 B1 3/2002 Toalson et al.
6,367,551 B1 4/2002 Fenton
6,388,577 B1 5/2002 Carstensen
6,457,529 B2 10/2002 Calder
6,457,530 B1 10/2002 Lam
6,457,540 B2 10/2002 Gardes
6,460,621 B2 * 10/2002 Fenton et al. ..... 166/347
6,481,504 B1 11/2002 Gatherar
6,484,807 B2 * 11/2002 Allen ..... 166/368
6,494,267 B2 12/2002 Allen
6,497,286 B1 12/2002 Hopper
6,516,861 B2 * 2/2003 Allen ..... 166/351
6,554,075 B2 4/2003 Filkes
6,557,629 B2 5/2003 Wong
6,612,368 B2 9/2003 Kent
6,612,369 B1 9/2003 Rocha
6,637,514 B1 10/2003 Donald
6,648,070 B2 * 11/2003 Cove et al. ..... 166/86.1
6,651,745 B1 11/2003 Lush
6,655,455 B2 * 12/2003 Bartlett et al. ..... 166/86.2
6,675,900 B2 1/2004 Baskett et al.
6,698,520 B2 * 3/2004 Fenton et al. ..... 166/347
6,719,059 B2 4/2004 Dezen et al.
6,755,254 B2 6/2004 DeBerry
6,760,275 B2 7/2004 Carstensen
6,763,890 B2 7/2004 Polsky et al.
6,763,891 B2 7/2004 Humphrey et al.
6,805,200 B2 10/2004 DeBerry
6,823,941 B2 11/2004 Donald
6,832,874 B2 * 12/2004 Appleford et al. ..... 405/189
6,840,323 B2 1/2005 Fenton

(56) References Cited

U.S. PATENT DOCUMENTS

| | | | | |
|---|---|---|---|---|
| 6,902,005 | B2 | 6/2005 | Radi et al. | |
| 6,907,932 | B2 | 6/2005 | Reimert | |
| 6,966,383 | B2 | 11/2005 | Millberger | |
| 6,968,902 | B2 | 11/2005 | Fenton | |
| 7,040,408 | B2 | 5/2006 | Sundararajan | |
| 7,069,995 | B2 * | 7/2006 | Chan et al. | 166/312 |
| 7,073,592 | B2 | 7/2006 | Polsky et al. | |
| 7,111,687 | B2 | 9/2006 | Donald | |
| 7,201,229 | B2 * | 4/2007 | White et al. | 166/368 |
| 7,210,530 | B2 | 5/2007 | Lush | |
| 7,243,729 | B2 | 7/2007 | Tyrrell et al. | |
| 7,270,185 | B2 | 9/2007 | Fontana | |
| 7,363,982 | B2 | 4/2008 | Hopper | |
| 7,520,989 | B2 * | 4/2009 | Ostergaard | 210/512.1 |
| 7,569,097 | B2 | 8/2009 | Campen | |
| 7,596,996 | B2 | 10/2009 | Zollo et al. | |
| 7,658,228 | B2 | 2/2010 | Moksvold | |
| 7,699,099 | B2 | 4/2010 | Bolding | |
| 7,718,676 | B2 | 5/2010 | Moussey | |
| 7,740,074 | B2 | 6/2010 | White | |
| 7,757,772 | B2 | 7/2010 | Donohue | |
| 7,770,653 | B2 | 8/2010 | Hill | |
| 7,823,648 | B2 | 11/2010 | Bolding | |
| 7,909,103 | B2 | 3/2011 | Fenton | |
| 8,011,436 | B2 | 9/2011 | Christie et al. | |
| 2001/0011593 | A1 * | 8/2001 | Wilkins | 166/368 |
| 2001/0050185 | A1 | 12/2001 | Calder et al. | |
| 2002/0000315 | A1 | 1/2002 | Kent et al. | |
| 2002/0070026 | A1 | 6/2002 | Fenton et al. | |
| 2002/0074123 | A1 | 6/2002 | Regan | |
| 2003/0010498 | A1 | 1/2003 | Tolman et al. | |
| 2003/0019632 | A1 | 1/2003 | Humphrey et al. | |
| 2003/0145997 | A1 | 8/2003 | Langford et al. | |
| 2003/0146000 | A1 | 8/2003 | Dezen et al. | |
| 2004/0026084 | A1 | 2/2004 | Donald | |
| 2004/0057299 | A1 | 3/2004 | Kozakai et al. | |
| 2004/0154790 | A1 | 8/2004 | Cornelssen et al. | |
| 2004/0154800 | A1 | 8/2004 | Jack et al. | |
| 2004/0200620 | A1 | 10/2004 | Ostergaard | |
| 2004/0206507 | A1 | 10/2004 | Bunney | |
| 2004/0251030 | A1 | 12/2004 | Appleford et al. | |
| 2005/0028984 | A1 | 2/2005 | Donald et al. | |
| 2005/0058535 | A1 | 3/2005 | Meshenky et al. | |
| 2005/0109514 | A1 | 5/2005 | White et al. | |
| 2005/0173322 | A1 | 8/2005 | Ostergaard | |
| 2005/0263194 | A1 | 12/2005 | Tseng et al. | |
| 2006/0237194 | A1 | 10/2006 | Donald et al. | |
| 2007/0144743 | A1 | 6/2007 | White et al. | |
| 2008/0047714 | A1 | 2/2008 | McMiles | |
| 2008/0128139 | A1 | 6/2008 | White | |
| 2008/0169097 | A1 | 7/2008 | Bolding et al. | |
| 2009/0025936 | A1 | 1/2009 | Donald et al. | |
| 2009/0126938 | A1 | 5/2009 | White | |
| 2009/0260831 | A1 | 10/2009 | Moksvold | |
| 2009/0266542 | A1 | 10/2009 | Donald et al. | |
| 2009/0266550 | A1 | 10/2009 | Fenton | |
| 2009/0294125 | A1 | 12/2009 | Donald et al. | |
| 2009/0294132 | A1 | 12/2009 | Donald et al. | |
| 2009/0301727 | A1 | 12/2009 | Donald et al. | |
| 2009/0301728 | A1 | 12/2009 | Donald et al. | |
| 2010/0025034 | A1 | 2/2010 | Donald et al. | |
| 2010/0044038 | A1 | 2/2010 | Donald et al. | |
| 2010/0206546 | A1 | 8/2010 | Donald et al. | |
| 2010/0206547 | A1 | 8/2010 | Donald et al. | |
| 2010/0206576 | A1 | 8/2010 | Donald et al. | |
| 2010/0300700 | A1 | 12/2010 | Garbett et al. | |
| 2011/0192609 | A1 | 8/2011 | Tan et al. | |

FOREIGN PATENT DOCUMENTS

| | | |
|---|---|---|
| CH | 638019 | 8/1983 |
| DE | 2541715 | 4/1976 |
| DE | 3738424 | 5/1989 |
| EP | 0036213 | 9/1981 |
| EP | 0568742 | 11/1993 |
| EP | 0572732 | 12/1993 |
| EP | 0719905 | 3/1996 |
| EP | 0952300 | 3/1998 |
| EP | 0841464 | 5/1998 |
| EP | 1990505 | 9/2002 |
| EP | 1639230 | 1/2009 |
| EP | 1918509 | 10/2009 |
| FR | 2710946 | 4/1995 |
| GB | 242913 | 11/1925 |
| GB | 1022352 | 3/1966 |
| GB | 2197675 | 5/1998 |
| GB | 2319795 | 6/1998 |
| GB | 2346630 | 8/2000 |
| GB | 2361726 | 10/2001 |
| GB | 0312543.2 | 5/2003 |
| GB | 0405454.0 | 3/2004 |
| GB | 0405471.4 | 3/2004 |
| GB | 2445493 | 7/2008 |
| NO | 20061778 | 5/2006 |
| WO | 90/08897 | 8/1990 |
| WO | 96/30625 | 10/1996 |
| WO | 98/15712 | 4/1998 |
| WO | 99/06731 | 2/1999 |
| WO | 99/28593 | 6/1999 |
| WO | 99/49173 | 9/1999 |
| WO | 00/47864 | 8/2000 |
| WO | 00/53937 | 9/2000 |
| WO | 00/70185 | 11/2000 |
| WO | 02/38912 | 5/2002 |
| WO | 02/088519 | 11/2002 |
| WO | 03/033868 | 4/2003 |
| WO | 03/078793 | 9/2003 |
| WO | 2005/040545 | 5/2005 |
| WO | 2005/047646 | 5/2005 |
| WO | 2005/083228 | 9/2005 |
| WO | 2006/041811 | 4/2006 |
| WO | 2007/075860 | 7/2007 |
| WO | 2007/079137 | 7/2007 |
| WO | 2008/034024 | 3/2008 |

OTHER PUBLICATIONS

Examination Report dated Jun. 30, 2011; European Application No. 10161117.6 (2p.).

Examination Report dated Jun. 30, 2011; European Application No. 10161120.0 (2p.).

Examination Report dated Jun. 30, 2011; European Application No. 10167181.6 (2p.).

Examination Report dated Jun. 30, 2011; European Application No. 10167182.4 (2p.).

Examination Report dated Jun. 30, 2011; European Application No. 10167183.2 (2p.).

Examination Report dated Jun. 30, 2011; European Application No. 10167184.0 (2p.).

Supplemental Notice of Allowance dated Jul. 7, 2011; U.S. Appl. No. 10/558,593 (7p.).

Response to Office Action dated Apr. 14, 2011; U.S. Appl. No. 12/768,324; Response filed Jul. 14, 2011 (7p.).

Response to Office Action dated Apr. 28, 2011; U.S. Appl. No. 12/768,332 (7 p.).

Notice of Allowance dated Jul. 22, 2011; U.S. Appl. No. 12/441,119 (15 p.).

European Search Report dated Dec. 2, 2010; European Application No. 10185612.8 (4 p.).

Norwegian Response to Office Action dated Jun. 22, 2011; Application No. 20015431 (19p.).

European Response to Search Opinion; Application No. 10185795.1; Response filed Aug. 3, 2011 (12 p.).

U.S. Office Action dated Jul. 21, 2011; U.S. Appl. No. 12/515,729 (53 p.).

Supplemental Notice of Allowance dated Aug. 8, 2011; U.S. Appl. No. 12/441,119 (9 p.).

Summons to Oral Proceedings dated Aug. 3, 2011; European Application No. 01980737.9 (3 p.).

(56) References Cited

OTHER PUBLICATIONS

European Response to Search Opinion; European Application No. 10013192.9; Response filed Aug. 10, 2011 (10 p.).
Notice of Allowability dated Aug. 26, 2011; U.S. Appl. No. 10/590,563 (11 p.).
European Office Action dated Aug. 22, 2011; Application No. 10185612.8 (2 p.).
U.S. Final Office Action dated Sep. 7, 2011; U.S. Appl. No. 12/541,937 (13 p.).
European Response to Oral Summons dated Sep. 22, 2011; EP Application No. 01980737.9 (42 p.).
Supplemental Notice of Allowance dated Oct. 11, 2011; U.S. Appl. No. 12/441,119 (8 p.).
Office Action dated Oct. 17, 2011; U.S. Appl. No. 12/768,337 (64 p.).
Notice of Allowance dated Oct. 17, 2011; U.S. Appl. No. 12/768,332 (56 p.).
Office Action dated Oct. 17, 2011; U.S. Appl. No. 12/768,324 (18 p.).
Canadian Office Action dated Oct. 14, 2011; Canadian Application No. 2,526,714 (3 p.).
Notice of Allowance dated Oct. 24, 2011; U.S. Appl. No. 12/515,534 (7 p.).
Corrected Notice of Allowance dated Oct. 26, 2011; U.S. Appl. No. 12/541,938 (8 p.).
European Exam Report dated Nov. 14, 2011; European Application No. 05781685.2 (3 p.).
European Decision to Grant dated Nov. 4, 2011; European Application No. 01980737.9 (4 p.).
Supplemental Notice of Allowability dated Dec. 6, 2011; U.S. Appl. No. 12/768,332 (10 p.).
Notice of Allowance dated Dec. 16, 2011; U.S. Appl. No. 13/116,889 (7 p.).
Response to Office Action dated Aug. 22, 2011; Response dated Dec. 22, 2011; European Application No. 10185612.8 (2 p.).
Office Action dated Dec. 22, 2011; U.S. Appl. No. 12/515,729 (31 p.).
Notice of Allowance dated Dec. 23, 2011; U.S. Appl. No. 12/768,337 (5 p.).
Examination Report dated Dec. 20, 2011; GB Application No. 0821072.6 (2 p.).
Observations dated May 10, 2011; GB Application No. 0821072.6 (19 p.).
European International Search Report dated Mar. 4, 2002; PCT/GB01/04940 (3 p.).
European Official Communication dated Mar. 5, 2003; Application No. 00929690.6 (2 p.).
European Response to Official Communication; Application No. 00929690.6; Response filed Jun. 27, 2003 (5 p.).
European Official Communication dated Aug. 29, 2003; Application No. 00929690.6 (3 p.).
European Examination Report dated Apr. 28, 2004; Application No. 00929690.6 (3 p.).
European Response to Examination Report; Application No. 00929690.6; Response filed Aug. 30, 2004.
European Communication dated Sep. 19, 2006; Application No. 01980737.9 (1 p.).
European Response to EPO Communication; Application No. 01980737.9; Response filed Oct. 6, 2006 (5 p.).
European Article 96(2) Communication dated Feb. 5, 2007; Application No. 04735596.1 (6 p.).
European Response to Examination Report; Application No. 047355961; Response filed Aug. 14, 2007 (15 p.).
European Search Report dated Apr. 16, 2007; Application No. 06024001.7 (2 p.).
European Article 96(2) Communication dated Jun. 12, 2007; Application No. 05717806.3 (3 p.).
European Response to Article 96(2) Communication dated Jun. 12, 2007; Application No. 05717806.3; Response filed Sep. 19, 2007 (17 p.).
European Examination Report dated Jun. 15, 2007; Application No. 01980737.9 (5 p.).
Response to European Examination Report dated Jun. 15, 2007; Application No. 01980737.9; Response filed Oct. 9, 2007 (12 p.).
European Examination Report dated Nov. 22, 2007; Application No. 04735596.1 (3 p.).
European Response to Examination Report dated Nov. 22, 2007; Application No. 04735596.1; Response filed Feb. 19, 2008 (101 p.).
European Examination Report dated Dec. 13, 2007; Application No. 06024001.7 (1 p.).
Response to European Examination Report dated Dec. 13, 2007; Application No. 06024001.7; Response filed Mar. 10, 2008 (6 p.).
European Search Report dated Mar. 28, 2008; Application No. 08000994.7 (4 p.).
European Response to Written Opinion dated Aug. 8, 2008; Application No. 08000994.7 (10 p.).
European Examination Report dated Oct. 30, 2008; Application No. 08000994.7 (2 p.).
European Response to Examination Report dated Oct. 30, 2008 w/amended specification; Application No. 08000994.7; Response filed Dec. 11, 2008 (94 p.).
European Examination Report dated May 18, 2009; Application No. 08162149.2 (8 p.).
European Response to Examination Report dated May 18, 2009; Application No. 08162149.2; Response filed Nov. 18, 2009 (132 p.).
Response to Article 94(3) and Rule 71(1) dated May 18, 2009; Application No. 08162149.2 (3 p.).
European Examination Report dated May 4, 2010; Application No. 07864486.1 (3 p.).
European Response to Examination Report dated May 4, 2010; Application No. 07864486.1; Response filed Nov. 12, 2010 (10 p.).
European Examination Report dated May 4, 2010; Application No. 07864482.0 (3 p.).
European Search Report dated Jun. 25, 2010; Application No. 10161116 (2 p.).
European Search Report dated Jun. 25, 2010; Application No. 10161117 (2 p.).
European Search Report dated Jun. 25, 2010; Application No. 10161120 (2 p.).
European Search Report dated Aug. 2, 2010; Application No. 10161117.6 (1 p.).
European Response to Examination Report dated Aug. 2, 2010; Application No. 10161117.6; Response filed Dec. 2, 2010 (6 p.).
European Examination Report dated Aug. 2, 2010; Application No. 10161116.8 (1 p.).
European Response to Examination Report dated Aug. 2, 2010; Application No. 10161116..8; Response filed Dec. 2, 2010 (13 p.).
European Examination Report dated Aug. 4, 2010; Application No. 10161120.0 (1 p.).
European Response to Examination Report dated Aug. 4, 2010; Application No. 10161120.0; Response filed Dec. 2, 2010 (6 p.).
European Examination Report dated Oct. 14, 2010; Application No. 10167181.6 (3 p.).
Response to European Examination Report dated Oct. 14, 2010; Application No. 10167181.6; Response filed Feb. 9, 2011 (6 p.).
European Examination Report dated Oct. 14, 2010; Application No. 10167183.2 (3 p.).
Response to European Examination Report dated Oct. 14, 2010; Application No. 10167183.2; Response filed Feb. 14, 2011 (4 p.).
European Examination Report dated Oct. 14, 2010; Application No. 10167182.4 (3 p.).
Response to European Examination Report dated Oct. 14, 2010; Application No. 10167182.4; Response filed Feb. 10, 2011 (6 p.).
European Examination Report dated Oct. 14, 2010; Application No. 10167184.0 (3 p.).
Response to European Examination Report dated Oct. 14, 2010; Application No. 10167184.0; Response filed Feb. 10, 2011 (8 p.).
European Examination Report dated Nov. 10, 2010; Application No. 07842464.5 (3 p.).
Response to European Examination Report dated Nov. 10, 2010; Application No. 07842464.5; Response filed Mar. 18, 2011 (11 p.).
European Search Report and Opinion dated Dec. 3, 2010; Application No. 10185795.1 (4 p.).
European Search Report dated Dec. 9, 2010; Application No. 10013192 (3 p.).

(56) References Cited

OTHER PUBLICATIONS

European Office Action Pursuant to Article 94(3) dated Dec. 29, 2010; Application No. 06024001.7 (4 p.).
Norwegian Examination Report dated Aug. 19, 2005; Application No. 20015431 (6 p.).
Response to Norwegian Examination Report dated Aug. 19, 2005; Application No. 20015431 (19 p.).
Norwegian Examination Report dated Mar. 22, 2010; Application No. 20032037 (8 p.).
Norwegian Office Action dated Oct. 20, 2010; Application No. 20032037 (4 p.).
International Search Report dated Mar. 4, 2002; PCT/GB01/04940 (3 p.).
International Search Report and Written Opinion dated Sep. 22, 2004; PCT/GB2004/002329 (13 p.).
International Search Report and Written Opinion dated Jun. 7, 2005; PCT/GB2005/000725 (8 p.).
International Search Report and Written Opinion dated Jan. 27, 2006; PCT/GB2005/003422 (8 p.).
International Search Report and Written Opinion dated Apr. 16, 2007; PCT/GB2004/002329 (10 p.).
International Search Report and Written Opinion dated Jun. 13, 2008; PCT/US2007/084884 (8 p.).
International Search Report and Written Opinion dated Jun. 13, 2008; PCT/US2007/084879 (9 p.).
International Search Report and Written Opinion dated Aug. 12, 2008; PCT/US2007/078346 (9 p.).
www.subsea7.com; "Multiple Application Re-Injection System" (undated) (2 p.).
Baker Hughes; "Intelligent Well System;Complete Range of Intelligent Well Systems," (undated) (4 p.).
Notice of Litigation for U.S. Appl. No. 10/558,593 (77 p.).
Patent Search Report INPADOC Patent Family (3 p.) (undated).
Venture Training Manual Part 1 (undated) (48 p.).
Venture Training Manual Part 2 (undated) (25 p.).
ABB Retrievable Choke Insert pp. 3, 8 (undated) (2 p.).
Kvaerner Pump Photo "G" (undated) (1 p.).
Aker Kvaerner; Multibooster System "H" (undated) (4 p.).
Progressing Cavity and Piston Pumps; National Oilwell "K" (undated) (2 p.).
Weatherford Artificial Lift Systems "M" (2 p.).
"Under Water Pump for Sea Bed Well" by A. Nordgren, "I" Dec. 14, 1987 (2 p.).
Petroleum Abstracts Oct. 25, 2001 (48 p.).
Petroleum Abstracts Oct. 30, 2001 (79 p.).
Derwent Abstracts Nov. 2, 2001 (16 p.).
www.subsea7.com "New Technology to Increase Oil Production Introduce to Subsea Market," Jun. 13, 2002 (2 p.).
ABB Brochure entitled "Subsea Chokes and Actuators" dated Oct. 2002 (12 p.).
Kvaerner Oilfield Products A.S. Memo-Multiphase Pumping Technical Issues, dated May 19, 2004 "D" (10 p.).
Offshore Article "Multiphase Pump," Jul. 2004 "C" (1 p.).
Jetech DA-4D & DA-8D Ultra-High Pressure Increases "L" (3 p.).
Force Pump, Double-Acting, Internet, Glossary "J" dated Sep. 7, 2004 (2 p.).
Online Publication: Weatherford Ram Pump dated Aug. 10, 2005 "B" (2 p.).
Framo Multiphase Booster Pumps dated Aug. 10, 2005 "F" (1 p.).
A750/09, in the Court of Session, Intellectual Property Action, Closed Record, in the Cause DES Operations et al. vs. Vetco Gray, Inc., et al., Updated record to include adjusted Answers to Minute of Amendment Oct. 21, 2010 (90p.).
A750/09, in the Court of Session, Intellectual Property Action, Note of Arguments for the First to Fifth Defenders Dec. 30, 2010 (18 p.).
A750/09, in the Court of Session, Intellectual Property Cause; Response to the Pursuers to the Note of Argument for the Defenders Mar. 3, 2011 (12 p.).
A750/09, in the Court of Session, Intellectual Property Action, Open Record, D.E.S. Operations Limited, Cameron Systems Ireland Limited (Pursuers) against Vetco Gray, Inc., Paul White, Paul Milne, and Norma Brammer (Defenders) Adjusted for the Pursuers Feb. 9, 2010 as further adjusted for the Pursuers Apr. 6, 2010 (53pp).
Initiation of Proceedings Before the Comptroller, Oct. 22, 2009; in the Matter of DES Operations Limited and Cameron Systems Ireland Limited and Vetco Gray Inc., and in the Matter of an Application Under Sections 133, 91A, 121A, and 371 of the Patent Act 1977, Statement of Grounds, Oct. 22, 2009 (21pp).
Singapore Examination Report dated Jan. 10, 2007; Application No. 200507390-3 (5 p.).
Singapore Written Opinion dated May 3, 2010; Application No. 200903220-2 (5 p.).
Singapore Written Opinion dated Oct. 12, 2010; Application No. 200903221-0 (11 p.).
Response to Singapore Written Opinion Dated Oct. 12, 2010; Application No. 200903221-0; Response filed Mar. 8, 2011 (11 p.).
U.S. Office Action dated Feb. 26, 2003; U.S. Appl. No. 10/009,991 (5 p.).
Response to Office Action dated Feb. 26, 2003; U.S. Appl. No. 10/009,991; Response filed May 12, 2003 (7 p.).
Notice of Allowance dated May 28, 2003; U.S. Appl. No. 10/009,991 (5 p.).
Provisional Application filed Oct. 22, 2003; U.S. Appl. No. 60/513,294 (15 p.).
Provisional Application filed Feb. 26, 2004; U.S. Appl. No. 60/548,630 (23 p.).
Provisional Application filed Feb. 26, 2004; U.S. Appl. No. 60/548,727 (36 p.).
U.S. Office Action dated Mar. 25, 2004; U.S. Appl. No. 10/415,156 (6 p.).
Response to Office Action dated Mar. 25, 2004; U.S. Appl. No. 10/415,156 (9 p.).
Notice of Allowance dated Jul. 26, 2004; U.S. Appl. No. 10/415,156 (4 p.).
U.S. Office Action dated Dec. 20, 2005; U.S. Appl. No. 10/651,703 (8 p.).
Response to Office Action dated Dec. 20, 2005; U.S. Appl. No. 10/651,703 (13 p.).
Notice of Allowance dated Apr. 26, 2006; U.S. Appl. No. 10/651,703 (7 p.).
Response to Notice of Allowance dated Apr. 26, 2006; U.S. Appl. No. 10/51,703 (7 p.).
Provisional Application filed Nov. 19, 2007; U.S. Appl. No. 61/190,048 (24 p.).
U.S. Office Action (Restriction Requirement) dated Feb. 11, 2008; U.S. Appl. No. 10/558,593 (7 p.).
Response to Office Action (Restriction Requirement) dated Feb. 11, 2008; U.S. Appl. No. 10/558,593 (12 p.).
U.S. Office Action (Restriction Requirement) dated Jul. 10, 2008; U.S. Appl. No. 10/558,593 (6 p.).
Response to Office Action (Restriction Requirement) dated Jul. 10, 2008; U.S. Appl. No. 10/558,593 (12 p.).
U.S. Office Action dated Jan. 8, 2009; U.S. Appl. No. 10/558,593 (8 p.).
Response to Office Action dated Jan. 8, 2009; U.S. Appl. No. 10/558,593 (31 p.).
Final Office Action dated Jul. 7, 2009; U.S. Appl. No. 10/558,593 (6 p.).
Response to Final Office Action dated Jul. 7, 2009; U.S. Appl. No. 10/558,593 (26 p.).
Office Action (Restriction Requirement) dated Jan. 7, 2010; U.S. Appl. No. 12/541,934 (5 p.).
Response to Office Action dated Jan. 7, 2010; U.S. Appl. No. 12/541,934 (6 p.).
U.S. Office Action dated Jul. 21, 2010 ; U.S. Appl. No. 10/558,593 (10 p.).
Response to Office Action dated Jul. 21, 2010; U.S. Appl. No. 10/558,593 (9 p.).
Office Action dated Aug. 12, 2010; U.S. Appl. No. 12/441,119 (14 p.).
Response to Office Action dated Aug. 12, 2010; U.S. Appl. No. 12/441,119; Response filed Nov. 8, 2010 (12 p.).

(56) References Cited

OTHER PUBLICATIONS

U.S. Office Action dated Aug. 31, 2010; U.S. Appl. No. 10/590,563 (13 p.).
Response to Office Action dated Aug. 31, 2010; U.S. Appl. No. 10/590,563; Response filed Nov. 29, 2010 (8 p.).
U.S. Office Action dated Oct. 6, 2010; U.S. Appl. No. 12/541,938 (7 p.).
Response to Office Action dated Oct. 6, 2010; U.S. Appl. No. 12/541,938; Response filed Jan. 11, 2011 (8 p.).
Office Action dated Dec. 7, 2010; U.S. Appl. No. 12/541,936 (12 p.).
Response to Office Action dated Dec. 7, 2010; U.S. Appl. No. 12/541,936; Response filed Jan. 20, 2011 (9 p.).
Notice of Allowance dated Jan. 6, 2011; U.S. Appl. No. 10/558,593 (26 p.).
Final Office Action dated Feb. 3, 2011; U.S. Appl. No. 12/441,119 (12 p.).
Office Action dated Feb. 16, 2011; U.S. Appl. No. 12/541,937 (7 p.).
Final Office Action dated Mar. 2, 2011; U.S. Appl. No. 10/590,563 (7 p.).
Response to Final Office Action dated Mar. 2, 2011; U.S. Appl. No. 10/590,563; Response filed Apr. 26, 2011 (8 p.).
Norwegian Office Action dated Mar. 28, 2011; Application No. 20015431 (3 p.) (1600-19226).
Response to Final Office Action dated Feb. 3, 2011; U.S. Appl. No. 12/441,119; Response filed Mar. 30, 2011 (11 p.).
Final Office Action dated Mar. 30, 2011; U.S. Appl. No. 12/541,938 (5 p.).
Response to Final Office Action dated Mar. 30, 2011; U.S. Appl. No. 12/541,938; Response filed Apr. 18, 2011 (10 p.).
Notice of Allowance dated Apr. 1, 2011; U.S. Appl. No. 12/541,936 (5 p.).
Notice of Allowance dated Apr. 4, 2011; U.S. Appl. No. 10/558,593 (5 p.).
U.S. Office Action dated Apr. 13, 2011; U.S. Appl. No. 12/441,119 (10 p.).
Office Action Dated Apr. 14, 2011; U.S. Appl. No. 12/768,324 (7 p.).
Office Action Dated Apr. 28, 2011; U.S. Appl. No. 12/768,332 (6 p.).
Notice of Allowance Dated May 6, 2011; U.S. Appl. No. 12/541,938 (5 p.).
U.S. Office Action/Advisory Action dated May 6, 2011; U.S. Appl. No. 10/590,563 (3p.).
U.S. Office Action dated May 25, 2011; U.S. Appl. No. 12/515,534 (7p.).
Supplemental Notice of Allowance dated Jun. 8, 2011; U.S. Appl. No. 12/541,936 (2p.).
Notice of Allowance dated Jun. 28, 2011; U.S Appl. No. 10/590,563 (14p.).
Response to Office Action dated Dec. 6, 2010; Canadian Application No. 2,526,714; Response filed Jun. 6, 2011 (16p.).
Response to Search Opinion; European Application No. 10185612.8; Response filed Jun. 29, 2011 (13p.).
European Response to Exam Report; European Application No. 10167184.0; Response filed Jan. 4, 2012 (142 p.).
Supplemental Notice of Allowability dated Jan. 9, 2012; U.S. Appl. No. 13/116,889 (10 p.).
European Response to Office Action; European Application No. 10185795.1; Response filed Jan. 23, 2012 (2 p.).
European Response to Office Action; European Application No. 10013192.9; Response filed Jan. 23, 2012 (2 p.).
Supplemental Notice of Allowance dated Jan. 26, 2012; U.S. Appl. No. 12/768,337 (10 p.).
Notice of Allowance dated Feb. 22, 2012; NO Application No. 20015431 (2 p.).
Response to Office Action dated Oct. 17, 2011; U.S. Appl. No. 12/768,324; Response filed Jan. 17, 2012 (7 p.).
Canadian Notice of Allowance dated Feb. 23, 2012; Canadian Application No. 2,555,403 (1 p.).
U.S. Notice of Allowance dated Mar. 29, 2012; U.S. Appl. No. 12/768,324; (18p.).
U.S. Response to Office Action Dated Dec. 22, 2011; Response filed Mar. 22, 2012; U.S. Appl. No. 12/515,729 (14p.).
U.S. Corrected Notice of Allowability dated Mar. 29, 2012; U.S. Appl. No. 13/116,889 (11p.).
Canadian Response to Office Action dated Oct. 7, 2011; Response filed Mar. 22, 2012; Canadian Application No. 2,526,714 (18 p.).
European Decision to Grant dated Mar. 15, 2012; European Application No. 01980737.9 (1 p.).
European Response to Office Action Dated Nov. 14, 2011; European Application No. 05781685.2; Response filed May 22, 2012 (3 p.).
U.S. Corrected Notice of Allowability dated Jun. 8, 2012; U.S. Appl. No. 12/768,324 (10 p.).
Australian Response to Office Action; Australian Application No. 2011200165I Response Filed Jun. 20, 2012 (124 p.).
European Office Action dated Feb. 7, 2012; European Application No. 07864482.0 (8 p.).
U.S. Office Action dated Jul. 20, 2012; U.S. Appl. No. 13/164,291 (71 p.).
Australian Examination Report dated Jul. 3, 2003; Application No. 47694/00 (2 p.).
Australian Response to Examination Report; Application No. 47694/00; Response filed Jul. 5, 2004 (20 p.).
Australian Examination Report dated Jul. 21, 2006; Application No. 2002212525 (2 p.).
Australian Response to Examination Report; Application No. 2002212525; Response filed Jun. 22, 2007 (33 p.).
Australian Examiner's Report dated Sep. 14, 2010; Application No. 2004289864 (2 p.).
Australian Response to Examiners Report; Application No. 2004289864; Response filed Dec. 7, 2010 (23 p.).
Australian Examiner's Report No. 3 dated Dec. 13, 2010; Application No. 2004289864 (1 p.).
Brazilian Examination Report dated Apr. 3, 2008; Application No. PI0115157-6 (3 p.).
Response to Brazilian Examination Report; Application No. PI0115157-6; Response filed Jul. 21, 2008 (7 p.).
Canadian Office Action dated Jan. 10, 2007; Application No. 2,373,164 (2 p.).
Response to Canadian Office Action; Application No. 2,373,164; Response filed Jul. 10, 2007 (16 p.).
Canadian Office Action dated Oct. 12, 2007; Application No. 2,428,165 (2 p.).
Response to Canadian Office Action; Application No. 2,428,165; Response filed Jan. 3, 2008 (16 p.).
Canadian Office Action dated Dec. 6, 2010; Application No. 2,526,714 (3 p.).
EP Preliminary Examination Report & Written Opinion dated Sep. 4, 2001; PCT/GB00/01785 (17 p.).
European Response to Office Action Dated Feb. 7, 2012; Application No. 07864482.0; Response Filed Aug. 9, 2012 (10 p.).
European Search Report and Opinion Dated Aug. 6, 2012; Application No. 12003132.3 (7 p.).
Canadian Office Action Dated Aug. 8, 2012; Canadian Application No. 2,526,714 (2 p.).
U.S. Office Action dated Sep. 4, 2012; U.S. Appl. No. 13/415,635 (5 p.).
U.S. Office Action dated Oct. 3, 2012; U.S. Appl. No. 13/536,433 (9 p.).
U.S. Office Action dated Oct. 12, 2012; U.S. Appl. No. 13/205,284 (9 p.).
U.S. Office Action dated Nov. 6, 2012; U.S. Appl. No. 13/405,997 (12 p.).
U.S. Response to Office Action Dated Jul. 20, 2012; U.S. Appl. No. 13/167,291; Response Filed Nov. 15, 2012 (13 p.).
U.S. Response to Office Action Dated Sep. 4, 2012; Application No. 13/415,635; Response Filed Dec. 4, 2012 (7 p.).
Lafitte, J.L., et al., "Dalia Subsea Production System: Presentation and Challenges," (OTC 18541) 2007 Offshore Technology Conference, Houston, Texas Apr. 30-May 3, 2007 (10 p.).
Dalia Brochure, Total S.A., Feb. 2007, France (98 p.).

(56) References Cited

OTHER PUBLICATIONS

U.S. Final Office Action Dated Dec. 24, 2012; U.S. Appl. No. 13/164,291 (6 p.).
Statement Accompanying Information Disclosure Statement; U.S. Appl. No. 13/536,433, filed Dec. 28, 2012; (3 p.).
U.S. Response to Final Office Action Dated Sep. 12, 2013; U.S. Appl. No. 13/415,635; Response Filed Nov. 12, 2013 (14 p.).
U.S. Response to Office Action Dated Jul. 19, 2013; U.S. Appl. No. 13/687,290; Response Filed Nov. 19, 2013 (17 p.).
U.S. Response to Final Office Action Dated Sep. 12, 2013 and Advisory Action Dated Nov. 25, 2013; U.S. Appl. No. 13/415,635; Response Filed Dec. 13, 2013 (12 p.).
U.S. Notice of Allowance Dated Jan. 14, 2014; U.S. Appl. No. 13/687,290 (8 p.).
U.S. Response to Final Office Action Dated Sep. 27, 2013; U.S. Appl. No. 13/591,443; Response Dated Dec. 27, 2013 (12 p.).
U.S. Advisory Action Dated Jan. 24, 2014; U.S. Appl. No. 13/591,443 (3 p.).

* cited by examiner

Fig. 13
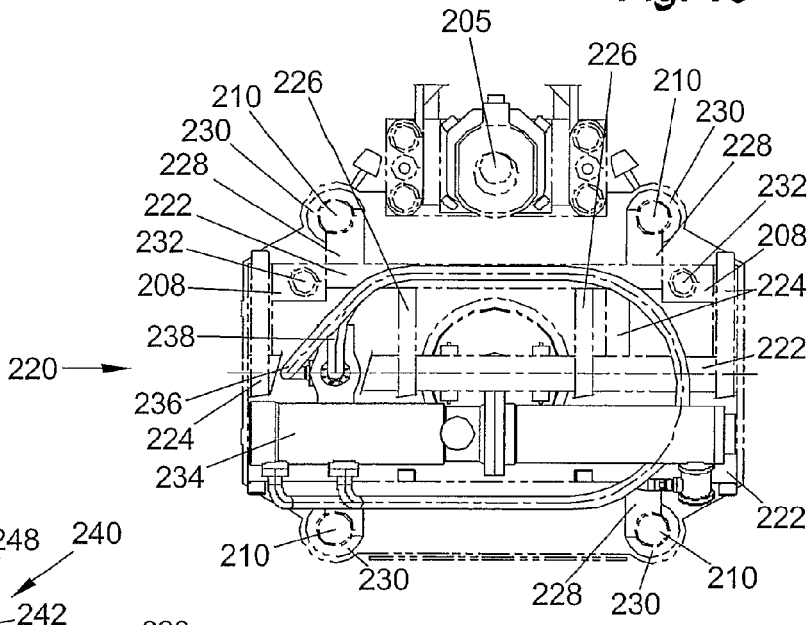
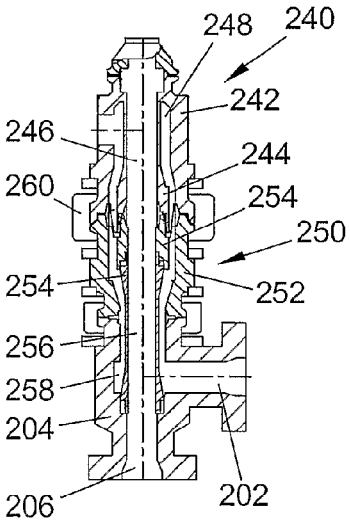
Fig. 12
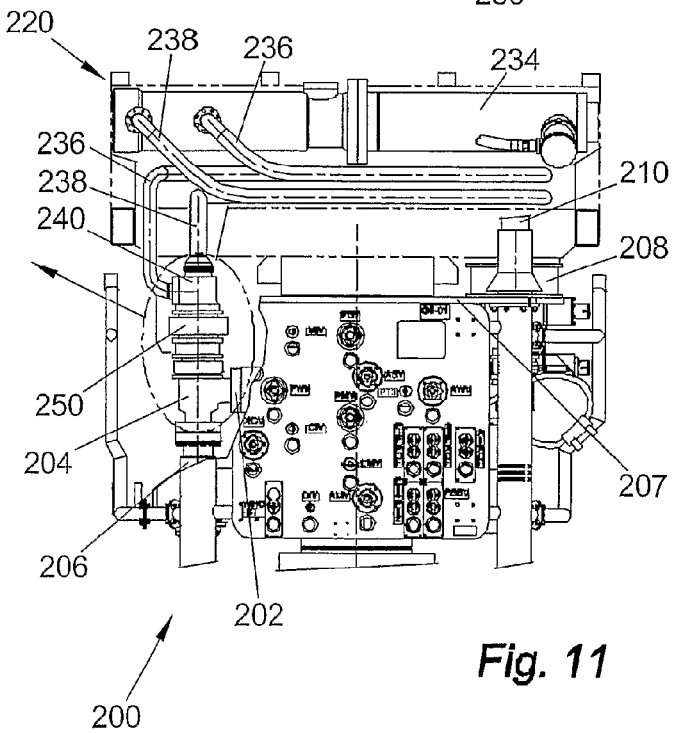
Fig. 11

Fig. 17A
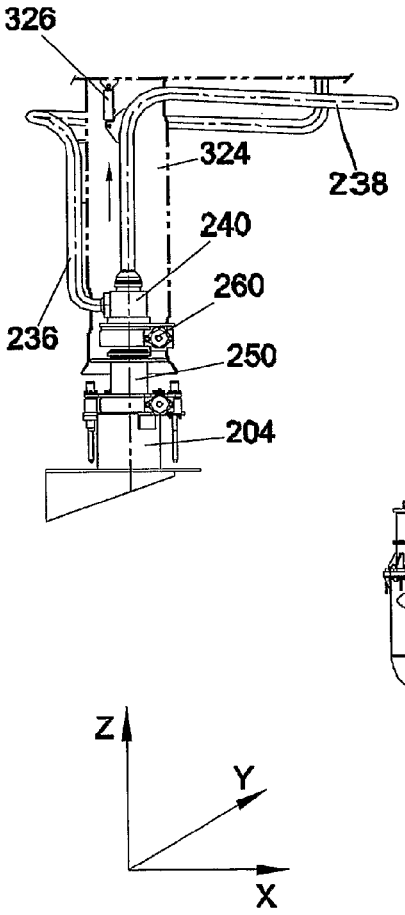
Fig. 17B
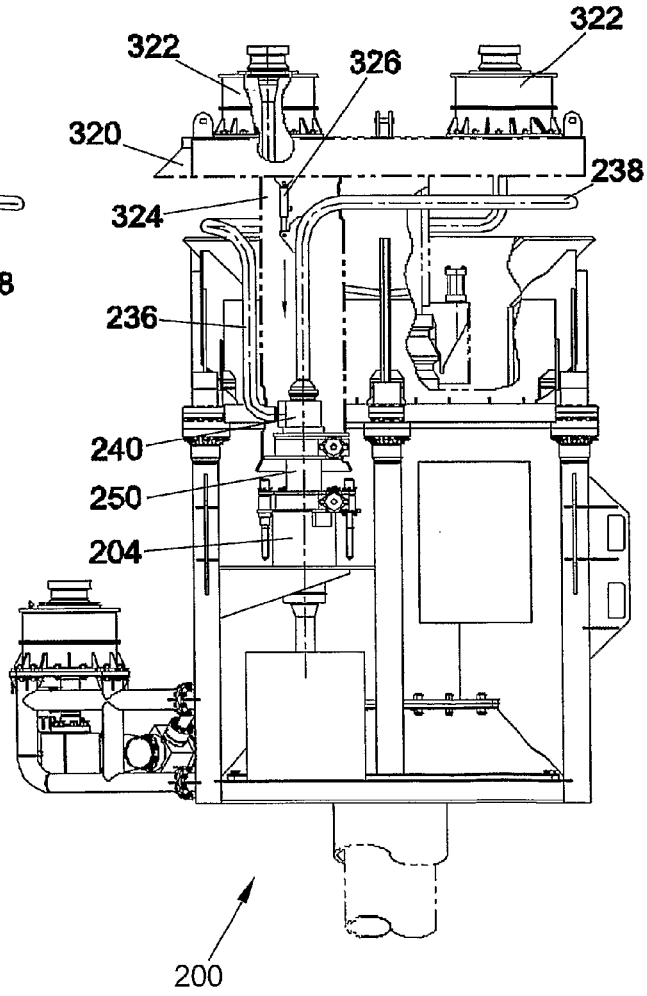
Fig. 17

CONNECTION SYSTEM FOR SUBSEA FLOW INTERFACE EQUIPMENT

CROSS REFERENCE TO RELATED APPLICATIONS

This application is a divisional of U.S. application Ser. No. 10/590,563 now U.S. Pat. No. 8,066,076 filed Dec. 13, 2007, which is a U.S. National Phase Application of PCT/GB2005/000725 filed Feb. 25, 2005, which claims the benefit of U.S. Provisional Application No. 60/548,727 filed Feb. 26, 2004, all of which are incorporated herein by reference in their entireties for all purposes.

BACKGROUND

This invention relates in general to subsea well production, and in particular to a connection system for connecting flow interface equipment, such as a pump to a subsea Christmas tree assembly.

DESCRIPTION OF RELATED ART

A subsea production facility typically comprises a subsea Christmas tree with associated equipment. The subsea Christmas tree typically comprises a choke located in a choke body in a production wing branch. There may also be a further choke located in an annulus wing branch. Typically, well fluids leave the tree via the production choke and the production wing branch into an outlet flowline of the well. However, in such typical trees, the fluids leave the well unboosted and unprocessed.

BRIEF SUMMARY OF THE INVENTION

According to a first aspect of the present invention there is provided an apparatus for connecting to a subsea wellbore, the wellbore having a manifold and a choke body, the apparatus comprising:

- a frame adapted to land on the manifold;
- a conduit system having a first end for connection to the interior of the choke body and a second end for connection to a processing apparatus;
- wherein the conduit system comprises a conduit means supported by the frame;
- wherein the frame comprises at least one frame member that is adapted to land on the manifold in a first stage of the connection and wherein the conduit means is adapted to be brought into fluid communication with the interior of the choke body in a second stage of the connection.

The two-stage connection provides the advantage that damage to the mating surfaces between the conduit means and the flow line of the tree assembly can be avoided whilst the frame is being landed, since at least a part of the frame is landed before the connection between the conduit means and the interior of the choke body is made up. Hence, the two-stage connection acts to buffer and protect the mating surfaces. The two-stage connection also protects the choke itself from damage whilst the frame is being landed; in particular, the mating surface of the choke is protected.

In some embodiments, processing apparatus e.g. multiphase flow meters and pumps can be mounted on the frame and can be landed on the tree with the frame. Alternatively, the processing apparatus may be located remote from the tree, e.g. on a further subsea installation such as a manifold or a pile, and the frame may comprise connections for jumper conduits which can lead fluids to and from the remote processing apparatus.

The processing apparatus allows well fluids to be processed (e.g. pressure boosted/injected with chemicals) at the wellhead before being delivered to the outlet flowline of the well. The invention may alternatively be used to inject fluids into the well using the outlet flowline as an inlet.

Often the processing apparatus, e.g. subsea pump, flow meter, etc. is quite heavy and bulky. In embodiments where heavy/bulky apparatus is carried by the frame, the risk of damage to the mating surfaces between the conduit means and the flow line of the tree assembly is particularly great.

Optionally, the apparatus further comprises an actuating means mounted on the frame, the actuating means being adapted to bring the conduit means into fluid communication with the interior of the choke body. Typically, the actuating means comprises at least one hydraulic cylinder. Alternatively, the actuating means may comprise a cable or a screw jack which connects the conduit means to the frame, to control the movement of the conduit means relative to the frame.

The conduit means is not necessarily brought into direct communication with the choke body. In some embodiments (the first embodiment and the third embodiment below), the conduit means is connected with the interior of the choke body via a further, secondary conduit.

In a first embodiment, a mounting apparatus is provided for landing a flow interface device, particularly a subsea pump or compressor (referred to collectively at times as "pressure intensifier") on a subsea production assembly.

Optionally, the at least one frame member of the first connection stage comprises a lower frame member, and the apparatus further comprises an upper frame member, the upper frame member and the lower frame member having co-operating engagement means for landing the upper frame member on the lower frame member.

In the first embodiment, a secondary conduit in the form of a mandrel with a flow passage is mounted to the lower frame member. The operator lowers the lower frame member into the sea and onto the production assembly. The production assembly has an upward facing receptacle that is sealingly engaged by the mandrel.

In this embodiment, the conduit means comprises a manifold, which is mounted to the upper frame member. The manifold is connected to a flow interface device such as a pressure intensifier, which is also mounted to the upper frame member. The operator lowers the upper frame member along with the manifold and pressure intensifier into the sea and onto the lower frame member, landing the manifold on the mandrel. During operation, fluid flows from the pressure intensifier through the manifold, the mandrel, and into the flow line.

Preferably, the subsea production assembly comprises a Christmas tree with a frame having guide posts. The operator installs extensions to the guide posts, if necessary, and attaches guidelines that extend to a surface platform. The lower and upper frame members have sockets with passages for the guidelines. The engagement of the sockets with the guide posts provides gross alignment as the upper and lower frame members are lowered onto the tree frame.

Also, preferably the Christmas tree frame has upward facing guide members that mate with downward facing guide members on the lower frame member for providing finer alignment. Further, the lower frame member preferably has upward facing guide members that mate with downward facing guide members on the upper frame member for providing finer alignment. One or more locking members on the lower frame member lock the lower frame member to the tree frame. Additionally, one or more locking members on the upper frame member lock the upper frame member to the lower frame member.

Optionally, the apparatus further comprises buffering means provided on the frame, the buffering means providing a minimum distance between the frame and the tree.

The buffering means may comprise stops or adjustable mechanisms, which may be incorporated with the locking members, or which may be separate from the locking members.

The adjustable stops define minimum distances between the lower frame member and the upper plate of the tree frame and between the lower frame member and the upper frame member.

The buffering means typically comprise threaded bolts, which engage in corresponding apertures in the frame, and which can be rotated to increase the length they project from the frame. The ends of the threaded bolts typically contact the upper frame member of the tree, defining a minimum distance between the frame and the tree.

Optionally, a further buffering means is provided between the lower and upper frame members to define a minimum distance between the lower and upper frame members. The further buffering means also typically comprises threaded bolts which extend between the lower and upper frame members. The extent of projection of the threaded bolts can be adjusted to provide a required separation of the upper and lower frame members.

The buffering means (e.g. the adjustable stops) provides structural load paths from the upper frame member through the lower frame member and tree frame to the tree and the wellhead on which the tree is mounted. These load paths avoid structural loads passing through the mandrel to the upward facing receptacle (i.e. the choke body).

In a second embodiment, the frame is lowered as a unit, but typically has an upper portion (an upper frame member) that is vertically movable relative to the lower portion (a lower frame member). A processing apparatus (in the form of a pressure intensifier) and a conduit means (a mandrel) are mounted to the upper portion. An actuating means comprising one or more jack mechanisms is provided between the lower and upper portions of the frame. When the lower portion of the frame lands on the tree frame, the lower end of the mandrel will be spaced above the flow line receptacle. The jack mechanisms then lower the upper portion of the frame, causing the mandrel to stab sealingly into the receptacle (the choke body). Thus, in this embodiment, the conduit means comprises a single mandrel having a single flowpath therethrough.

In a third embodiment, the conduit means has a flexible portion. Preferably, the flexible portion is moveable relative to the frame. Typically, the flexible portion of the conduit means is fixed relative to the frame at a single point. Typically, the flexible portion of the conduit means is connected to the processing apparatus and supported at the processing apparatus connection, in embodiments where the processing apparatus is supported on the frame.

Optionally, the conduit means comprises two conduits, one of which is adapted to carry fluids going towards the processing apparatus, the other adapted to carry fluids returning from the processing apparatus. Typically, each of the two conduits of the conduit means is fixed relative to the frame at a respective point. Typically, the flexible portion of each of the two conduits of the conduit means is connected to the processing apparatus and is supported at the processing apparatus connection (where a processing apparatus is provided on the frame).

Typically, the flexible portion of the conduit means is resilient. Typically, the direction of movement of the flexible portion of the conduit means in the second stage of the connection defines an axis of connection and the flexible portion of the conduit means is curved in a plane perpendicular to the axis of connection to provide resilience in the connection direction. In such embodiments, the flexible portion of the conduit means is in the form of a coil, or part of a coil. This allows the lower end of the conduit means (the connection end) to be moved resiliently in the connection direction.

Typically, the flexible portion of the conduit means supports a connector adapted to attach to the choke body (either directly or via a further conduit extending from the choke body), the flexible portion of the conduit means allowing relative movement of the connector and the frame to buffer the connection.

Typically, an actuating means is provided which is adapted to move the flexible portion relative to the frame to bring an end of the flexible portion into fluid communication with the interior of the choke body. The actuating means typically comprises a swivel eye mounting hydraulic cylinder.

Considering now all embodiments of the invention, the conduit system may optionally provide a single flowpath between the choke body and the processing apparatus.

Alternatively, the conduit system provides a two-flowpath system: a first flowpath from the choice body to the processing apparatus and a second flowpath from the processing apparatus to the choke body. In such embodiments, the conduit system can comprise a housing and an inner hollow cylindrical member, the inner cylindrical member being adapted to seal within the interior of the choke body to define a first flow region through the bore of the cylindrical member and a second separate flow region in the annulus between the cylindrical member and the housing.

Typically, the first and second flow regions are adapted to connect to a respective inlet and an outlet of the processing apparatus.

Such embodiments can be used to recover fluids from the well via a first flowpath, process these using the processing apparatus (e.g. pressure boosting) and then to return the fluids to the choke body via a second flowpath for recovery through the production wing branch. The division of the inside of the choke body into first and second flow regions by the inner cylindrical member allows separation of the first and second flowpaths within the choke body.

If used, the housing and the inner hollow cylindrical member typically are provided as the part of the conduit system that directly connects to the choke body, i.e. in the first embodiment, this is the secondary conduit; in the second embodiment, the conduit means, and in the third embodiment, the secondary conduit.

Optionally, the processing apparatus is provided on the frame. In this case, the processing apparatus is typically connected to the conduit means before the frame is landed on the tree.

Alternatively, the processing apparatus is provided on a further subsea manifold, such as a suction pile. Jumper cables can be connected between the frame on the manifold and the further subsea manifold to connect the processing apparatus to the conduit system. In this case, the processing apparatus is typically connected to the conduit means as a final step.

In all embodiments, the frame typically includes guide means that co-operate with guide means provided on the manifold, to align the frame with the manifold. The frame may also or instead comprise a guide pipe that surrounds at least a part of the conduit system, to protect it from impact damage.

All embodiments use the space inside the choke body after the choke bonnet has been removed and the choke withdrawn. However, it may still be desirable to be able to use a choke to control the fluid flow. Optionally, a replacement choke is provided on the frame, the replacement choke being connectable to the conduit system.

Embodiments of the invention can be used for both recovery of production fluids and injection of fluids.

According to a second aspect, of the present invention there is provided a method of connecting a processing apparatus to a subsea wellbore, the wellbore having a manifold and a choke body, the method comprising:

landing a frame on the manifold and connecting a conduit system between the choke body and the processing apparatus, the frame supporting a conduit means of the conduit system;

wherein the frame comprises at least one frame member that is landed on the manifold in a first connection stage, and wherein the conduit means is brought into fluid communication with the interior of the choke body in a second connection stage.

The method typically includes the initial steps of removing the choke bonnet and connecting the secondary conduit to interior of the choke body.

The choke bonnet is removed and the secondary conduit may be installed by choke bonnet changing equipment (e.g. the third embodiment). Alternatively, the secondary conduit may be supported on the lower frame member and may be installed when the lower frame member is landed on the manifold (e.g. the first embodiment).

According to a third aspect of the present invention there is provided an apparatus for connecting to a subsea wellbore, the wellbore having a manifold and a choke body, the apparatus comprising:

a frame having a conduit system, the frame being adapted to land on the tree, the conduit system including a first end which is adapted to connect to the choke body such that the conduit is in fluid communication with the interior of the choke body, and a second end connectable to a processing apparatus;

wherein the frame comprises buffering means adapted to buffer the connection between the first end of the conduit system and the choke body.

In the first embodiment, the buffering means may be provided by the adjustable stop means, which provide structural load paths from the upper frame member through the lower frame member and tree frame to the tree and the wellhead on which the tree is mounted which avoid structural loads passing through the mandrel to the choke body.

In the second embodiment, the buffering means is typically provided by the arrangement of the upper and lower frame members, the upper frame member being moveable to lower the mandrel (the conduit means) into connection with the choke body in a controlled manner, only after the frame has been landed.

In the third embodiment, the buffering means may be provided by the flexible portion of the conduit means, which allows movement of the conduit end that connects to the secondary conduit. Therefore, the connection end of the conduit means will not heavily impact into the secondary conduit as it is able to deflect as necessary, using the flexibility of the conduit means, and can optionally be maneuvered for even greater control (e.g. by an actuating mechanism).

According to a fourth aspect of the present invention there is provided an apparatus for connecting to a subsea wellbore, the wellbore having a manifold and a choke body, the apparatus comprising:

a frame adapted to land on the manifold;

a conduit system having a first end for connection to the choke body and a second end for connection to a processing apparatus;

wherein at least a part of the conduit system is supported by the frame;

wherein the conduit system comprises at least one flexible conduit having an end that is moveable relative to the frame to make up a communication between the processing apparatus and the choke body.

In such embodiments, the end of the flexible conduit can deflect if it impacts with the choke body (or any secondary conduit extending from the choke body). Thus in such embodiments, the flexible conduit ensures that the load carried by the frame is not transferred to the choke body.

BRIEF DESCRIPTION OF THE DRAWINGS

Embodiments of the invention will now be described, by way of example only, and with reference to the following drawings, in which:—

FIG. 11 is a side view with interior details of a third embodiment of the invention;

FIG. 12 is an enlarged view in cross-section of a portion A of the FIG. 11 embodiment;

FIG. 13 is a plan view of the FIG. 11 embodiment;

FIG. 17 shows an alternative embodiment similar to that of FIG. 16, wherein an actuating means is provided to control the movement of a conduit means.

DETAILED DESCRIPTION OF THE INVENTION

Figure 1:
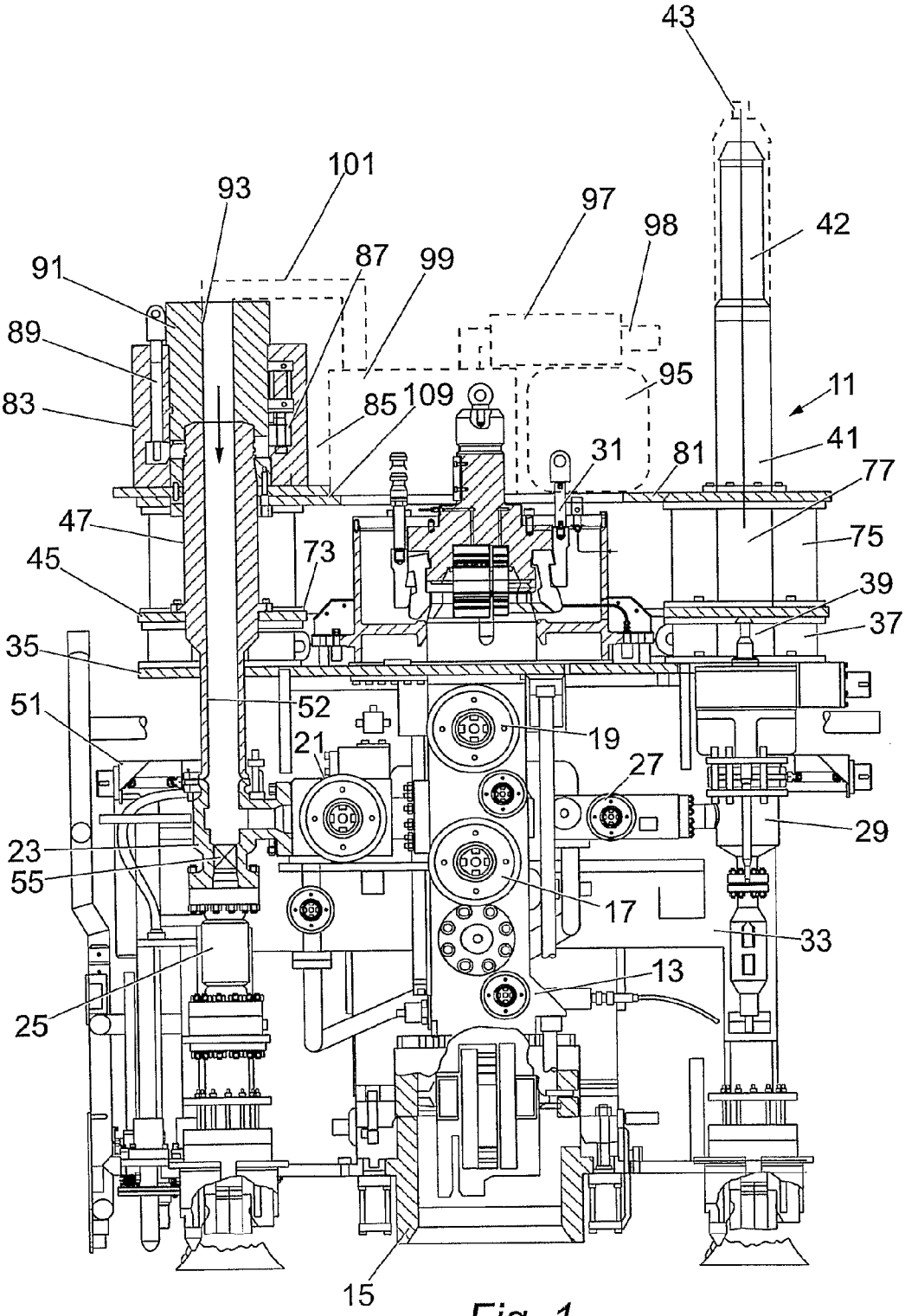
FIG. 1 is an elevational view of a subsea tree assembly, partially in section, and showing an apparatus for connecting a flow interface to a subsea wellbore.

Referring to FIG. 1, production assembly 11 in this example includes a subsea Christmas tree 13. Christmas tree 13 is a tubular member with a tree connector 15 on its lower end that connects to a wellhead housing (not shown) located on the sea floor. Tree 13 may be conventional, having a vertical bore with a master valve 17 and a swab valve 19. A production passage in tree 13 leads laterally to a production wing valve 21. Tree 13 may be either a type having a tubing hanger landed within, or it may be a type in which the tubing hanger lands in the wellhead housing below the tree.

A production choke body or receptacle 23 mounts to production wing valve 21. Choke body 23 comprises a housing for a choke insert (not shown) that is adjustable to create a back pressure and a desired flow rate. Choke body 23 connects to a production flow line 25 that leads to sea floor processing equipment or directly to a production facility at sea level. After being installed with a pressure intensifier, as will be subsequently explained, a choke insert may not be required. One use for the connecting apparatus of this invention is to retrofit existing trees that have previously operated without a pressure intensifier.

Tree 13 may also have an annulus valve 27 that communicates with a tubing annulus passage (not shown) in the well. An annulus choke 29 connects to annulus valve 27 for controlling a flow rate either into or out of the tubing annulus. Annulus choke 29 is normally located on a side of production assembly 11 opposite production choke body 23. Annulus choke 29 has a body with a choke insert similar to production choke body 23.

Figure 3:
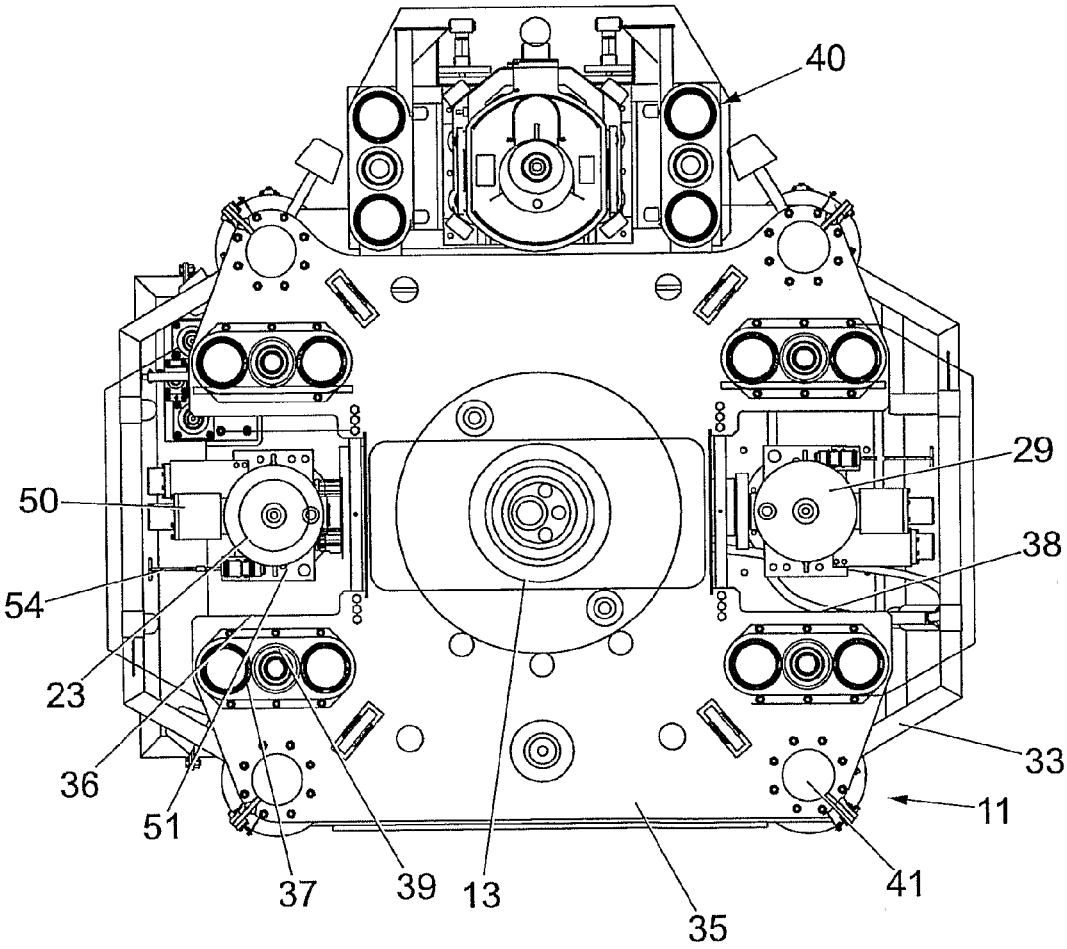
FIG. 3 is a top view of the tree frame of FIG. 1, with the connecting apparatus for the flow interface device removed.

A tree cap 31 releasably mounts to the upper end of tree 13. A tree frame 33 extends around tree 13 for mounting various associated equipment and providing protection to tree 13 if snagged by fishing nets. Tree frame 33 is structurally connected to the body of tree 13, such that weight imposed on tree frame 33 transfers to tree 13 and from there to the wellhead housing (not shown) on which tree 13 is mounted. Tree frame 33 has an upper frame member portion or plate 35 that in this instance is located above swab valve 19 and below tree cap 31. Upper plate 35 surrounds tree 13, as shown in FIG. 3, and is generally rectangular in configuration. Tree frame upper plate 35 has a cutout 36 that provides vertical access to choke body 23 and a cutout 38 that provides vertical access to annulus choke 29.

As shown in FIG. 3, preferably tree frame upper plate 35 has a plurality of guide members 37. Guide members 37 may vary in type, and prior to retrofitting with a pressure intensifier, were used to land equipment for retrieving and replacing the choke insert (not shown) in choke body 23 and in annulus choke 29. Although some subsea trees do not have any type of guide members, many do, particularly trees installed during the past 10-15 years. In this example, each guide member 37 comprises an upward facing cylinder with an open top. Guide members 37 are mounted in pairs in this example with a locking member 39 located between them. Locking member 39 has a latch that latches onto a locking member inserted from above. Four separate sets of guide members 37 are shown in FIG. 3, with one set located on opposite sides of cutout 36 and the other sets on opposite sides of cutout 38.

FIG. 3 also shows a control pod receptacle 40 that may be conventional. Control pod receptacle 40 has guide members 37 and locking members 39 for landing an electrical and hydraulic control pod (not shown) lowered from sea level. A plurality of guide posts 41 are located adjacent sides of tree frame 33. Typically, each guide post 41 is located at a corner of tree frame 33, which is generally rectangular in configuration. Only one guide post 41 is shown in FIG. 1, but the other three are the same in appearance. The existing guide posts 41 likely may not be long enough for the retrofit of a pressure intensifier in accordance with this invention. If so, a guide post extension 42 is installed over each guide post 41, and becomes a part of each guide post 41. Guide post extensions 42 protrude upward past tree cap 31. A guideline 43 with a socket on its lower end slides over and connects to each guide post 41 or guide post extension 42, if such are used. Guidelines 43 extend upward to a platform or workover vessel at sea level.

Figure 4:
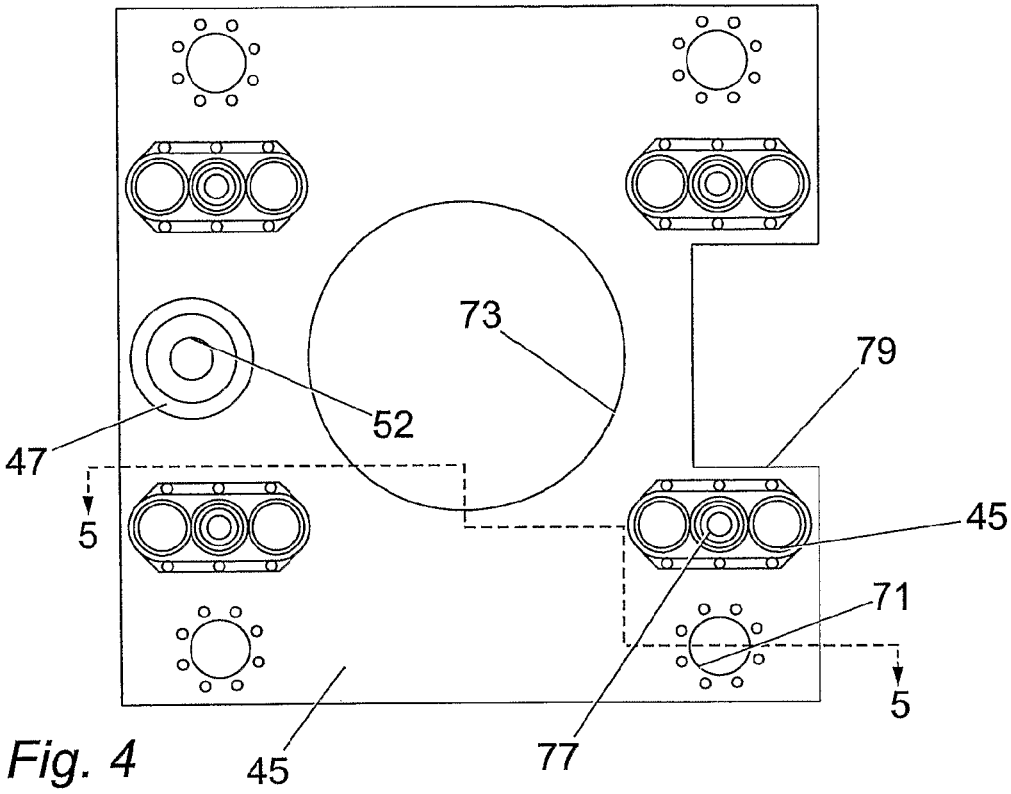
FIG. 4 is a top view of a lower frame member of the connecting apparatus of FIG. 1.

Still referring to FIG. 1, a flow interface device lower frame member 45 lands on and is supported by tree frame upper plate 35. In this embodiment, lower frame member 45 is a flat generally rectangular member, as shown in FIG. 4, but it need not be a flat plate. A mandrel 47 is secured to one side of lower frame member 45. Mandrel 47 has a tubular lower portion with a flange 49 that abuts and seals to a mating flange on choke body 23. Alternatively, mandrel 47 could be positioned on an opposite edge of lower frame member 45 and mate with the body of annulus choke 29, rather than choke body 23.

A clamp 51 locks flange 49 to the flange of choke body 23. Clamp 51 is preferably the same apparatus that previously clamped the choke insert (not shown) into choke body 23 when production assembly 11 was being operated without a pressure intensifier. Clamp 51 is preferably actuated with an ROV (remote operated vehicle) to release and actuate clamp 51.

Figure 2:
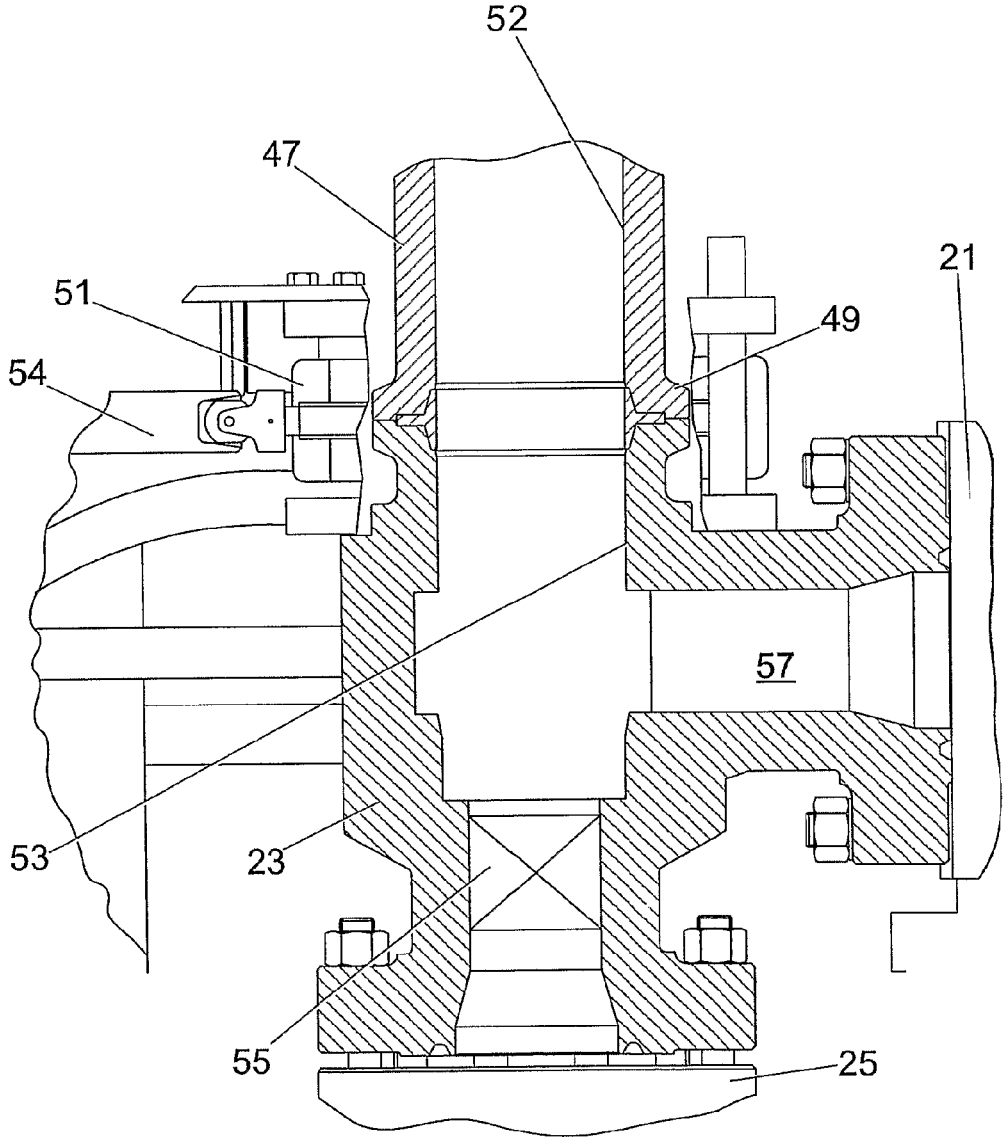
FIG. 2 is an enlarged view, partially in section, of a choke body of the tree assembly and a lower portion of a mandrel of the apparatus of FIG. 1.

Referring to FIG. 2, mandrel 47 has a lower bore 52 that aligns with choke body vertical bore 53. A retrievable plug 55 is shown installed within a lower portion of choke vertical bore 53. A lateral passage 57 leads from choke body vertical bore 53 above plug 55 to production wing valve 21 (FIG. 1). Plug 55 prevents fluid flowing down through mandrel 47 from entering flow line 25. Some installations have a valve in flow line 25 downstream of choke body 23. If so, plug 55 is not required.

Figure 5:
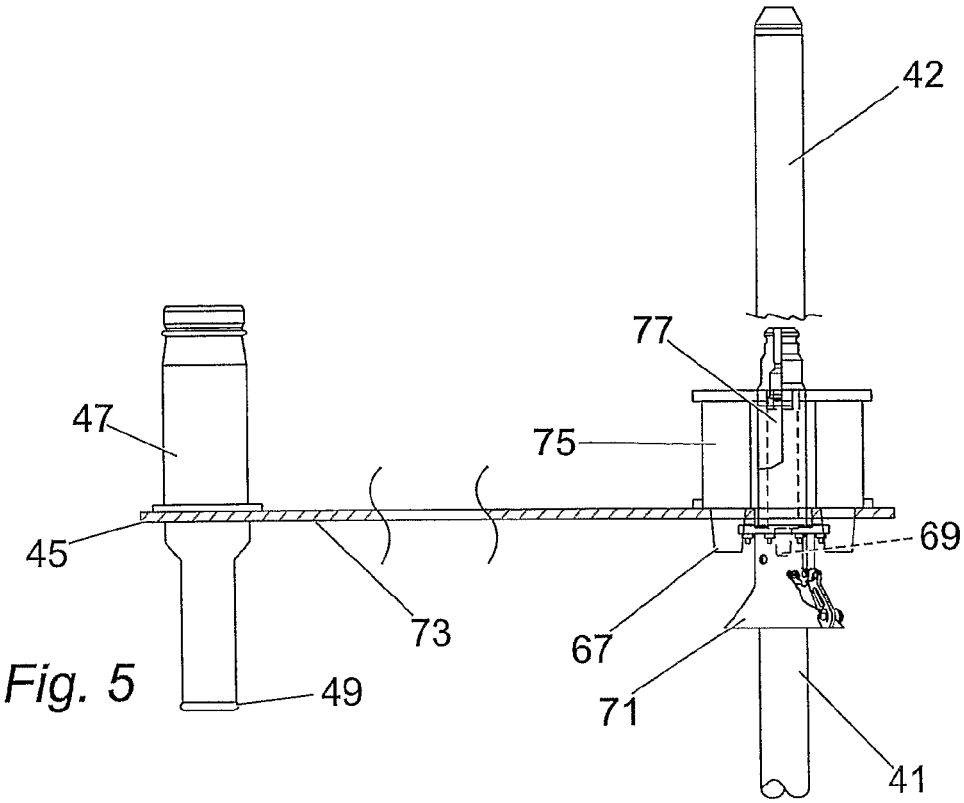
FIG. 5 is a sectional view of the lower frame member of FIG. 4, taken along the line 5-5 of FIG. 4.

Referring to FIG. 5, lower frame member 45 has a plurality of guide members 67 on its lower side that mate with guide members 3'7 of tree frame upper plate 35 as show in FIG. 3. Only one of the sets of guide members 67 is shown, and they are shown in a schematic form. Furthermore, a locking member 69 protrudes downward from lower frame member 45 for locking engagement with one of the locking members 39 (FIG. 3) of tree frame upper plate 35. Lock member 69 is also shown schematically. Other types of locks are feasible.

Lower frame member 45 also has guide post sockets 71, each preferably being a hollow tube with a downward facing funnel on its lower end. Guide post sockets 71 slide over guide lines 43 (FIG. 1) and guide posts 41 or extensions 42. Guide posts 41 or their extensions 42 provide a gross alignment of mandrel 47 with choke body 23 (FIG. 1). Guides 67 and 37 (FIG. 1) provide finer alignment of mandrel 47 with choke body 23 (FIG. 1).

Referring still to FIG. 5, lower frame member 45 also preferably has a plurality of upward facing guide members 75. In this example, guide members 75 are the same type as guide members 37 (FIG. 3), being upward facing cylinders with open tops. Other types of guide members may be utilized as well. In this instance, preferably there are four sets of guide members 75, with each set comprising two guide members 75 with a locking member 77 located between as shown in FIG. 4. Guide members 75 are located in vertical alignment with guide members 37 (FIG. 3), but could be positioned elsewhere. Lower frame member 45 also has a cutout 79 on one side for providing vertical access to annulus choke 29 (FIG. 3).

An adjustment mechanism or mechanisms (not shown) may extend between lower frame member 45 and tree frame upper plate 37 to assure that the weight on lower frame member 45 transfers to tree frame upper plate 37 and not through mandrel 47 to choke body 23. While the lower end of mandrel 47 does abut the upper end of choke body 23, preferably, very little if any downward load due to any weight on lower frame member 45 passes down mandrel 47 to choke body 23. Applying a heavy load to choke body 23 could create excessive bending moments on the connection of production wing valve 21 to the body of tree 13. The adjustment mechanisms may comprise adjustable stops on the lower side of lower frame member 45 that contact the upper side of tree frame upper plate 37 to provide a desired minimum distance between lower frame member 45 and upper plate 37. The minimum distance would assure that the weight on lower frame member 45 transfers to tree upper plate 35, and from there through tree frame 33 to tree 13 and the wellhead housing on which tree 13 is supported. The adjustment mechanisms could be separate from locking devices 69 or incorporated with them.

Referring to FIG. 1, after lower frame member 45 lands and locks to tree frame upper plate 35, an upper frame member 81 is lowered, landed, and locked to lower frame member 45. Upper frame member 81 is also preferably a generally rectangular plate, but it could be configured in other shapes. Upper frame member 81 has a mandrel connector 83 mounted on an upper side. Mandrel connector 83 slides over mandrel 47 while landing. A locking member 85, which could either be a set of dogs or a split ring, engages a grooved profile on the exterior of mandrel 47. Locking member 85 locks connector 83 to mandrel 47. A hydraulic actuator 87 strokes locking member 85 between the locked and released positions. Preferably, mandrel connector 83 also has a manual actuator 89 for access by an ROV in the event of failure of hydraulic actuator 87. A manifold 91 is a part of or mounted to an upper inner portion of mandrel connector 83. Manifold 91 has a passage 93 that sealingly registers with mandrel passage 52.

As shown by the dotted lines, a motor 95, preferably electrical, is mounted on upper frame member 81. A filter 97 is located within an intake line 98 of a subsea pump 99. Motor 95 drives pump 99, and the intake in this example is in communication with sea water. Pump 99 has an outlet line 101 that leads to passage 93 of manifold 91.

Figure 6:
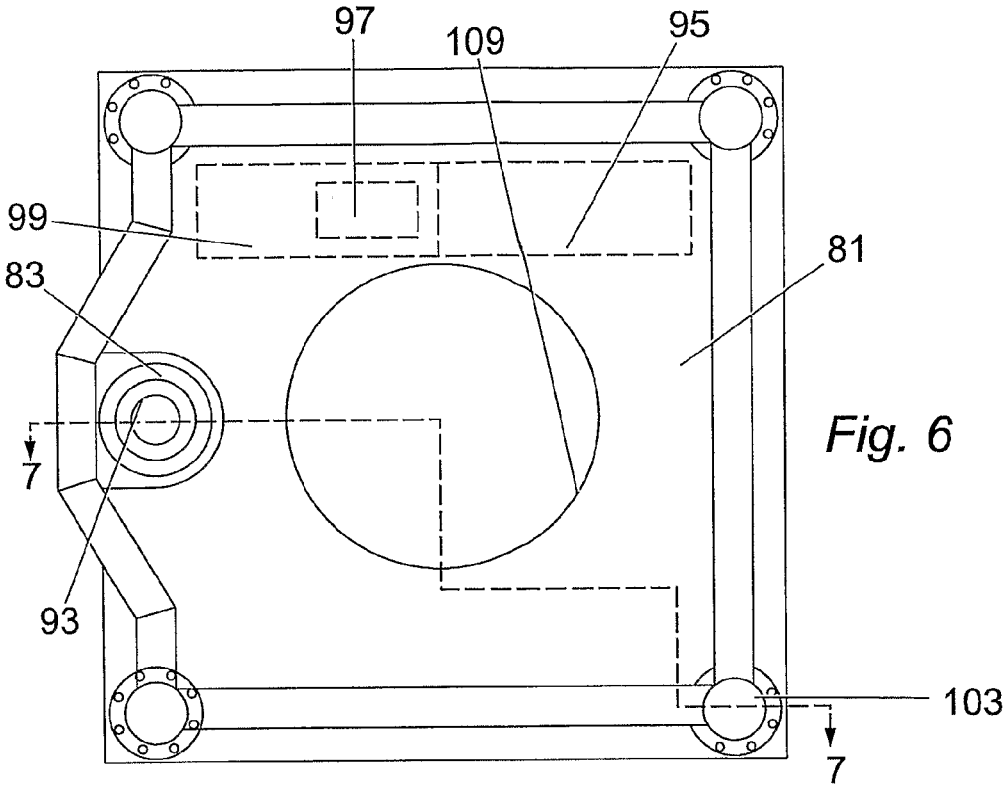
FIG. 6 is a top view of an upper frame member of the connecting apparatus of FIG. 1.
Figure 7:
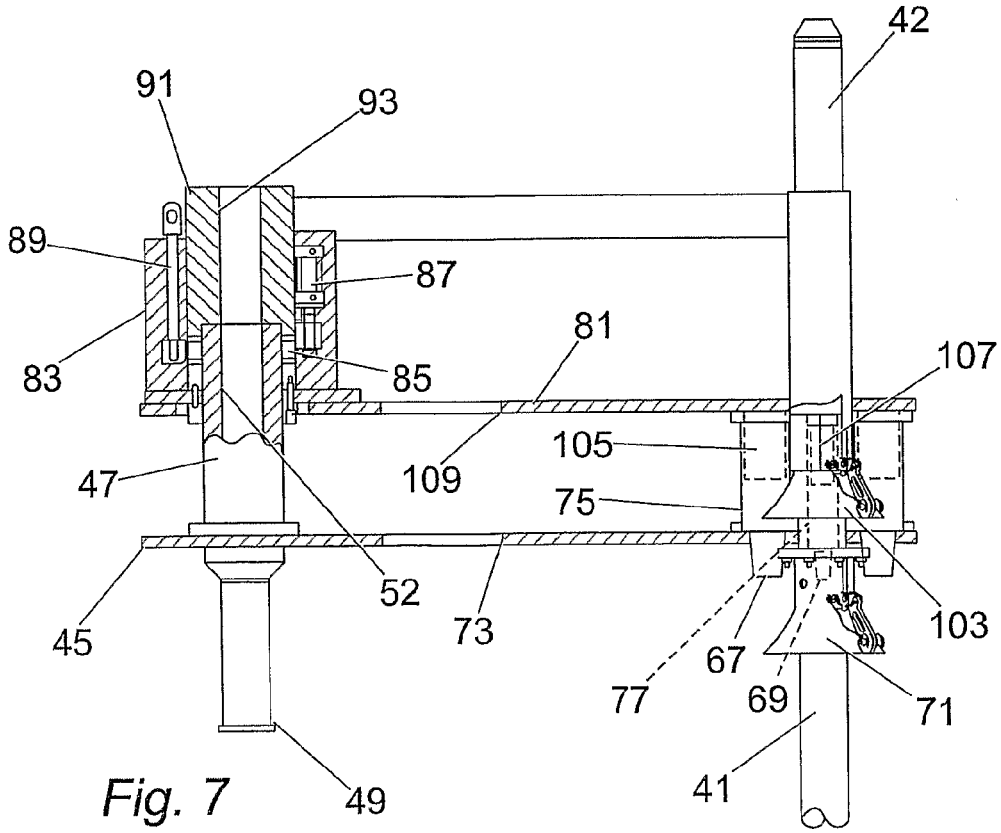
FIG. 7 is a partially sectioned view of the upper frame member of FIG. 6, taken along the line 7-7 of FIG. 6.

As shown in FIG. 6, upper frame member 81 has four guide post sockets 103 for sliding down guidelines 43 (FIG. 1) and onto the upper portions of guide posts 41 or guide post extensions 42. Upper frame member 81 has downward extending guide members 105 that mate with upward extending guide members 75 of lower frame member 45, as shown in FIG. 7. Locking members 107 mate with locking members 77 (FIG. 4) of lower frame member 45. Upper frame member 81 has a central hole 109 for access to tree cap 31 (FIG. 1).

Adjustable mechanisms or stops (not shown) may also extend between lower frame member 45 and upper frame member 81 to provide a minimum distance between them when landed. The minimum distance is selected to prevent the weight of pump 99 and motor 95 from transmitting through mandrel connector 83 to mandrel 47 and choke body 23. Rather, the load path for the weight is from upper frame member 81 through lower frame member 45 and tree frame upper plate 35 to tree 13 and the wellhead housing on which it is supported. The load path for the weight on upper frame member 81 does not pass to choke body 23 or through guide posts 41. The adjustable stops could be separate from locking devices 107 or incorporated with them.

In the operation of this example, production assembly 11 may have been operating for some time either as a producing well, or an injection well with fluid delivered from a pump at a sea level platform. Also, production assembly 11 could be a new installation. Lower frame member 45, upper frame member 81 and the associated equipment would originally not be located on production assembly 11. If production assembly 11 were formerly a producing well, a choke insert (not shown) would have been installed within choke body 23.

To install pressure intensifier 99, the operator would attach guide post extensions 42, if necessary, and extend guidelines 43 to the surface vessel or platform. The operator removes the choke insert in a conventional manner by a choke retrieval tool (not shown) that interfaces with the two sets of guide members 37 adjacent cutout 36 (FIG. 3). If production assembly 11 lacks a valve on flow line 25, the operator lowers a plug installation tool on guidelines 43 and installs a plug 55.

The operator then lowers lower frame member 45 along guidelines 43 and over guide posts 41. While landing, guide members 67 and lock members 69 (FIG. 5) slidingly engage upward facing guide members 37 and locking members 39 (FIG. 1). The engagement of guide members 37 and 67 provides fine alignment for mandrel 47 as it engages choke body 23. Then, clamp 51 is actuated to connect the lower end of mandrel 47 to choke body 23.

The operator then lowers upper frame member 81, including pump 99, which has been installed at the surface on upper frame member 81. Upper frame member 81 slides down guidelines 43 and over guide posts 41 or their extensions 42. After manifold 91 engages mandrel 47, connector 83 is actuated to lock manifold 91 to mandrel 47. Electrical power for pump motor 95 may be provided by an electrical wet-mate connector (not shown) that engages a portion of the control pod (not shown), or in some other manner. If the control pod did not have such a wet mate connector, it could be retrieved to the surface and provided with one.

Once installed, with valves 17 and 21 open, sea water is pumped by pump 99 through outlet line 101, and flow passages 93, 52 (FIG. 2) into production wing valve 21. The sea water flows down the well and into the formation for water flood purposes. If repair or replacement of pressure intensifier 99 is required, it can be retrieved along with upper frame member 81 without disturbing lower frame member 45.

Figure 8:
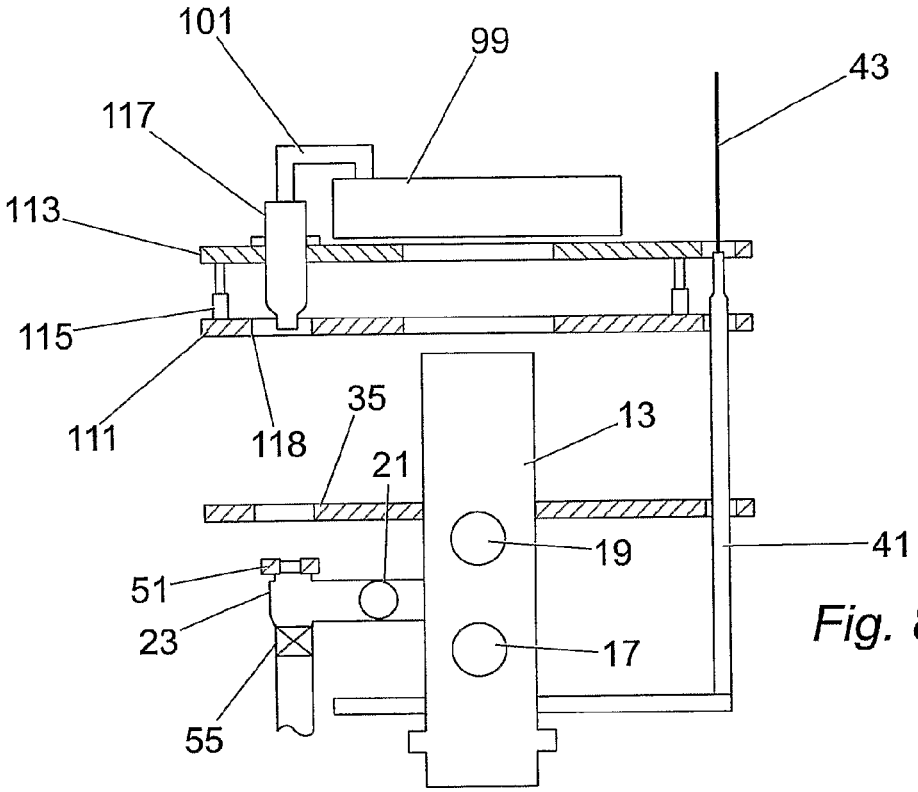
FIG. 8 is a schematic view of an alternate embodiment of a connecting system, shown prior to landing on the subsea tree assembly.
Figure 9:
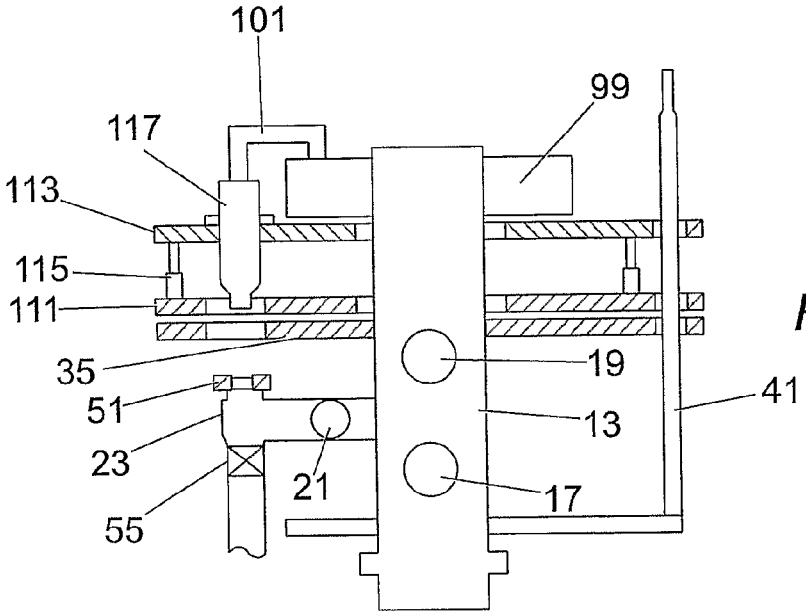
FIG. 9 is a schematic view of the mounting system of FIG. 8, with a lower frame member of the connecting system landed on the subsea tree assembly and the upper frame member in an upper position.
Figure 10:
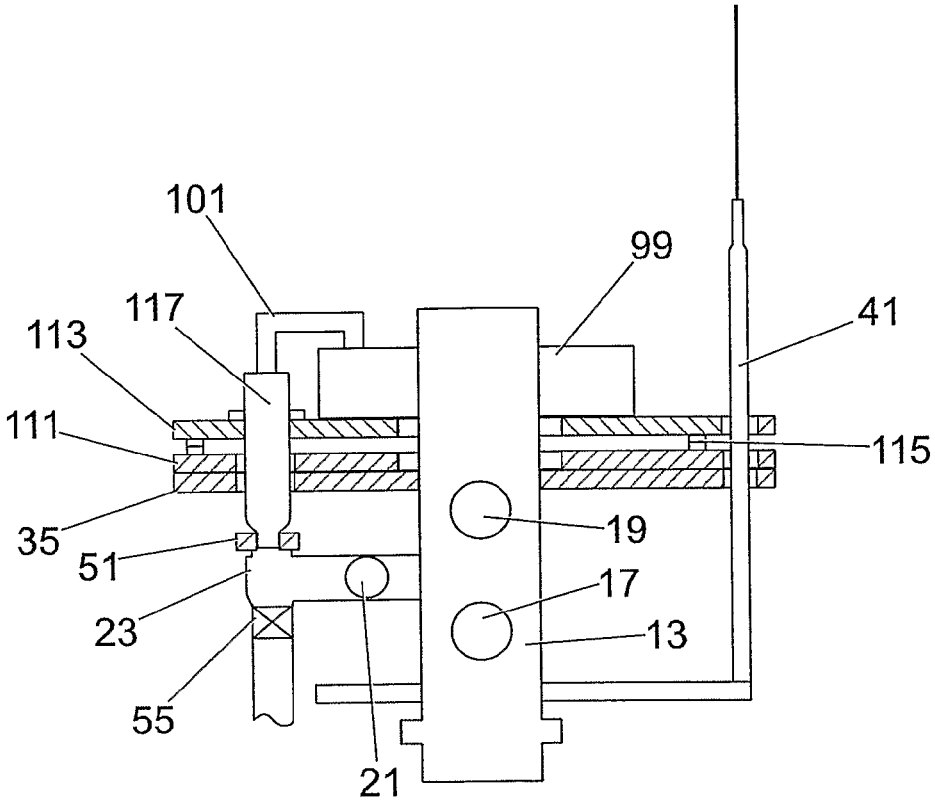
FIG. 10 is a schematic view of the subsea tree assembly and the connecting system of FIG. 8, with the upper frame member in a lower position.

An alternate embodiment is shown in FIGS. 8-10. Components that are the same as in the first embodiment are numbered the same. The mounting system has a lower frame member or frame portion 111 and an upper frame member or frame portion 113. Jack mechanisms, such as hydraulic cylinders 115, extend between lower and upper frame members 111, 113. Hydraulic cylinders 115 move upper frame member 113 relative to lower frame member 111 from an upper position, shown in FIGS. 8 and 9, to a lower position, shown in FIG. 10. Lower frame member 111 preferably has guide members on its lower side for engaging upward facing guides on tree frame upper plate 35, although they are not shown in the drawings.

Mandrel 117 is rigidly mounted to upper frame member 113 in this embodiment and has a manifold portion on its upper end that connects to outlet line 101, which in turn leads from pressure intensifier or pump 99. Mandrel 117 is positioned over or within a hole 118 in lower frame member 111. When upper frame member 113 moves to the lower position, shown in FIG. 10, mandrel 117 extends down into engagement with the receptacle of choke body 23.

In the operation of the second embodiment, pressure intensifier 99 is mounted to upper frame member 113, and upper and lower frame members 113, 111 are lowered as a unit.

Hydraulic cylinders 115 will support upper frame member 113 in the upper position. Guidelines 43 and guide posts 41 guide the assembly onto tree frame upper plate 35, as shown in FIG. 9. Guide members (not shown) provide fine alignment of lower frame member 111 as it lands on tree frame upper plate 35. The lower end of mandrel 117 will be spaced above choke body 23. Then hydraulic cylinders 115 allow upper frame member 113 to move downward slowly. Mandrel 117 engages choke body 23, and clamp 51 is actuated to clamp mandrel 117 to choke body 23. Locks (not shown) lock lower and upper frame members 111, 113 to the tree frame of tree 13.

FIGS. 11 to 13 show a third embodiment of the invention. FIG. 11 shows a manifold in the form of a subsea Christmas tree 200. The tree 200 has a production wing branch 202, a choke body 204, from which the choke has been removed, and a flowpath leading to a production wing outlet 206. The tree has an upper plate 207 on which are mounted four "John Brown" feet 208 (two shown) and four guide legs 210. The guide legs 210 extend vertically upwards from the tree upper plate 207. The tree also supports a control module 205.

FIGS. 11 and 13 also show a frame 220 (e.g. a skid) located on the tree 200. The frame 220 has a base that comprises three elongate members 222 which are cross-linked by perpendicular bars 224 such that the base has a grid-like structure. Further cross-linking arched members 226 connect the outermost of the bars 222, the arched members 226 curving up and over the base of the frame 220.

Located at approximately the four corners of the frame 220 are guide funnels 230 attached to the base of the frame 220 on arms 228. The guide funnels 230 are adapted to receive the guide legs 210 to provide a first (relatively course) alignment means. The frame 220 is also provided with four "John Brown" legs 232, which extend vertically downwards from the base of the frame 220 so that they engage the John Brown feet 208 of the tree 200.

A processing apparatus in the form of a pump 234 is mounted on the frame 200. The pump 234 has an outlet and inlet, to which respective flexible conduits 236, 238 are attached. The flexible conduits 236, 238 curve in a plane parallel to the base of the frame 220, forming a partial loop that curves around the pump 234 (best shown in FIG. 13). After nearly a complete loop, the flexible conduits 236, 238 are bent vertically downwards, where they connect to an inlet and an outlet of a piping interface 240 (to be described in more detail below). The piping interface 240 is therefore suspended from the pump 234 on the frame 220 by the flexible conduits 236, 238, and is not rigidly fixed relative to the frame 220. Because of the flexibility of the conduits 236, 238, the piping interface 240 can move both in the plane of the base of the frame 220 (i.e. in the horizontal plane of FIG. 11) and in the direction perpendicular to this plane (vertically in FIG. 11). In this embodiment, the conduits 236, 238 are typically steel pipes, and the flexibility is due to the curved shape of the conduits 236, 238, and their respective single points of suspension from the pump 234, but the conduits could equally be made from an inherently flexible material or incorporate other resilient means.

Figure 15:
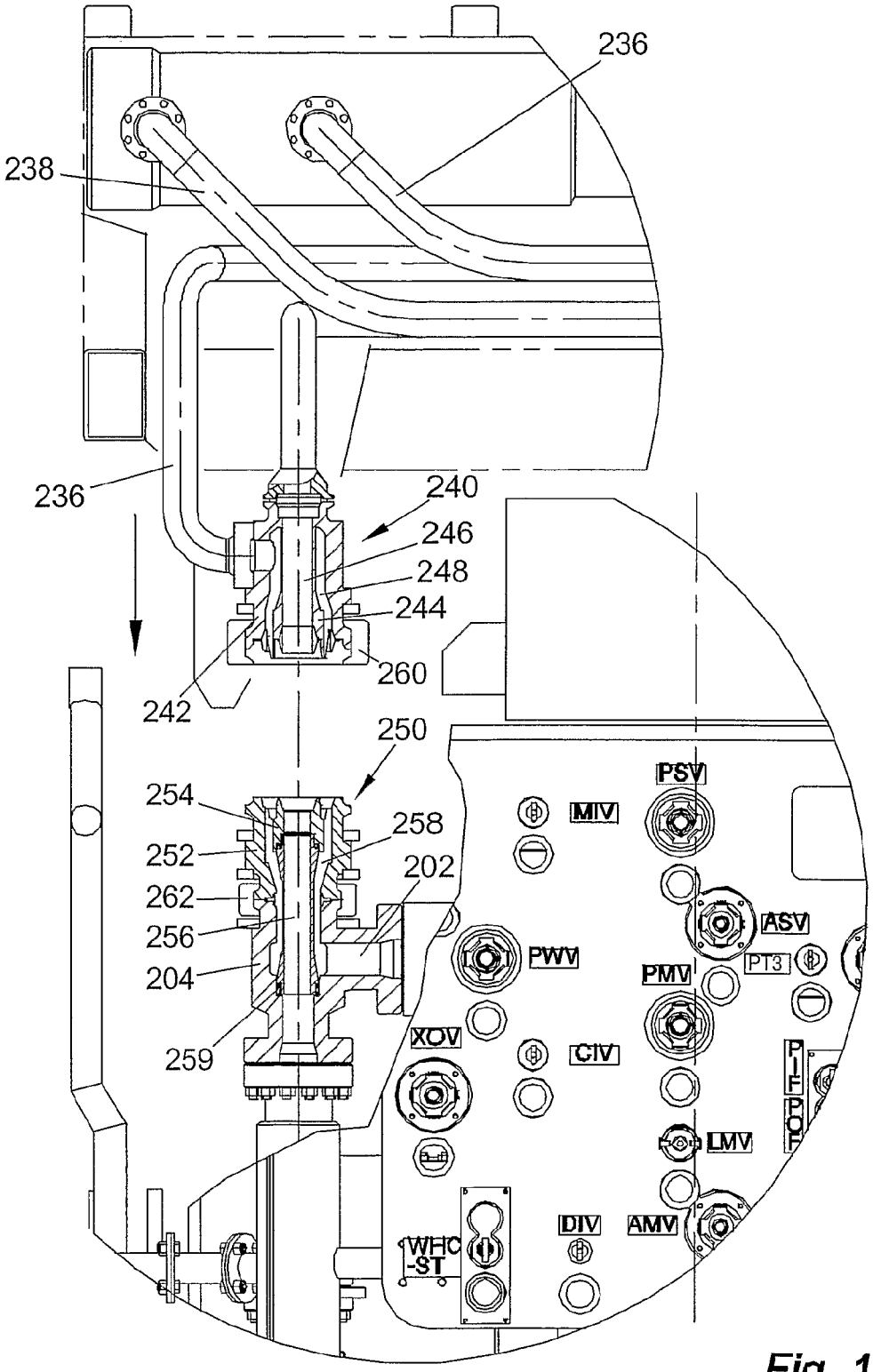
FIG. 15 shows an enlarged view of FIG. 14D.

A secondary conduit 250 is connected to the choke body 204, as best shown in FIG. 15. The secondary conduit 250 comprises a housing 252 in which an inner member 254 is supported. The inner member 254 has a cylindrical bore 256 extending therethrough, which defines a first flow region that communicates with the production wing outlet 206. The annulus 258 between the inner cylindrical member 254 and the housing 252 defines a second flow region that communicates with the production wing branch 202.

The upper portion of the secondary conduit 250 is solid (not shown in the cross-sectional view of FIG. 15) and connects the inner member 254 to the housing 252; the solid upper portion has a series of bores therethrough in its outer circumference, which provides a continuation of the annulus 258. The inner member 254 comprises two portions; for ease of manufacture, which are screwed together before the secondary conduit 250 is connected to the choke body 204.

The inner member 254 is longer than the housing 252, and extends into the choke body 204 to a point below the production wing branch 202. The end of the inner member 254 is provided with a seal 259, which seals in the choke body 204 to prevent direct flow between the first and second flow regions. The secondary conduit 250 is clamped to the choke body 204 by a clamp 262 (see FIG. 12) that is typically the same clamp as would normally clamp the choice in the choke body 204. The clamp 262 is operable by an ROV.

Also shown in FIG. 15 is a detailed view of the piping interface 240; the FIG. 15 view shows the piping interface 240 before connection with the secondary conduit 250. The piping interface comprises a housing 242 in which is supported an inner member 244. The inner member has a cylindrical bore 246, an upper end of which is in communication with the flexible conduit 238. An annulus 248 is defined between the housing 242 and the inner member 244, the upper end of which is connected to the flexible conduit 236. The piping interface 240 and the secondary conduit 250 have co-operating engaging surfaces; in particular the inner member 254 of the secondary conduit 250 is shaped to stab inside the inner member 244 of the piping interface 240. The outer surfaces of the housings 242, 252 are adapted to receive a clamp 260, which clamps these surfaces together.

The piping interface 240 is shown connected to the secondary conduit 250 in the views of FIGS. 11 and 12. As shown in FIG. 12, the inner member 254 of the secondary conduit 250 is stabbed inside the inner member 244 of the piping interface 240, and the clamp 260 clamps the housings 242, 252 together. The cylindrical bores 256, 246 are therefore connected together, as are the annuli 248, 258. Therefore, the cylindrical bores 256 and 246 form a first flowpath which connects the flexible conduit 238 to the production wing outlet 206, and the annuli 248 and 258 form a second flowpath which connects the production wing branch 202 to the flexible conduit 236.

Figure 14:
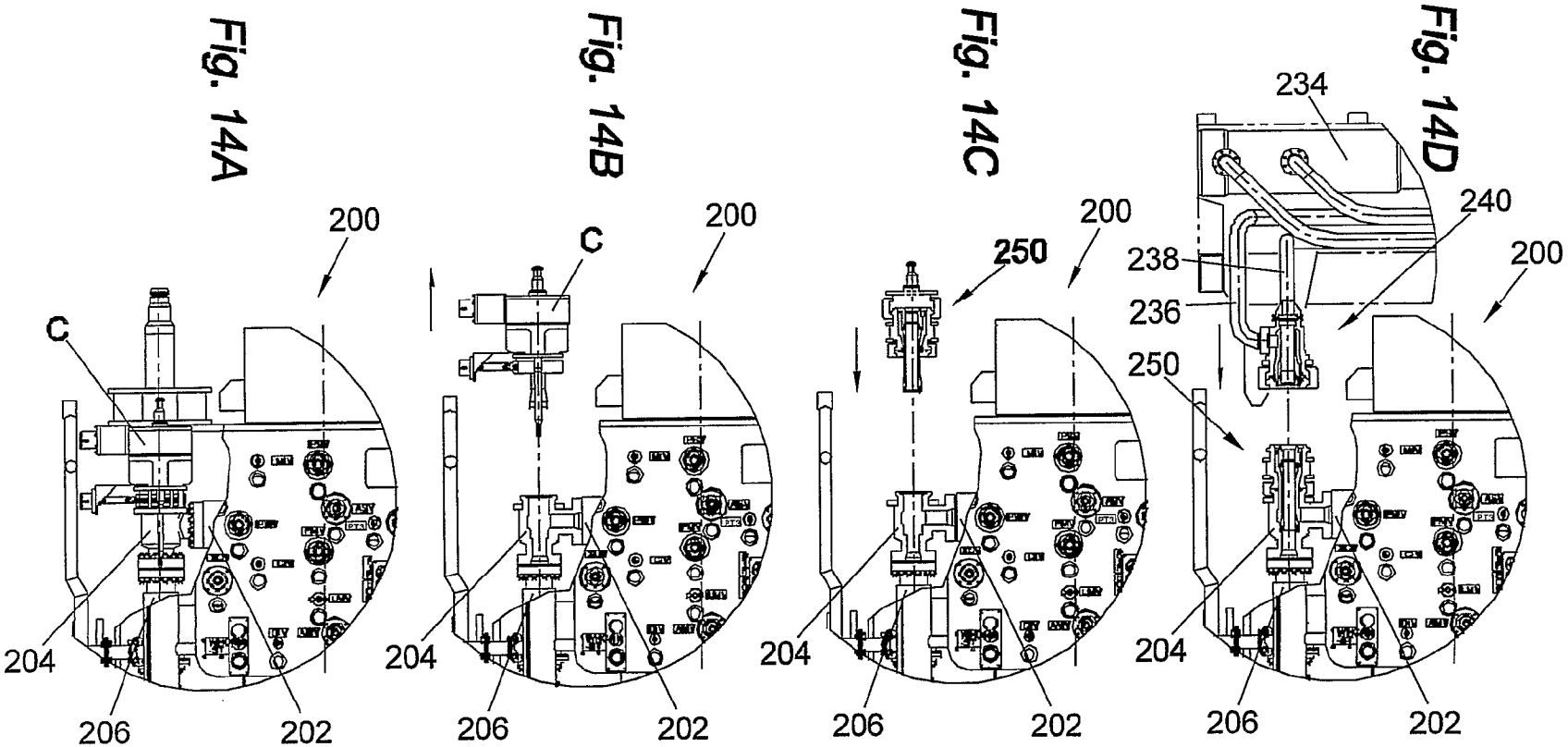
FIG. 14 shows a series of views with cross-sectional details showing the FIG. 11 apparatus being installed on a manifold.

A method of connecting the pump 234 to the choke body 204 will now be described with reference to FIG. 14.

FIG. 14A shows the tree 200 before connection of the pump 234, with a choke C installed in the choke body 204.

The production wing valve is closed and the choke C is removed, as shown in FIG. 14B, to allow access to the interior of the choke body 204. This is typically done using conventional choke change out tooling (not shown).

FIG. 14C shows the secondary conduit 250 being lowered onto the choke body 204. This can also be done using the same choke change out tooling. The secondary conduit 250 is clamped onto the choke body 204 by an ROV operating clamp 262.

FIG. 14D shows the secondary conduit 250 having landed on and engaged with the choke body 204, and the piping interface 240 being subsequently lowered to connect to the piping interface 240. FIG. 15 shows a magnified version of FIG. 14D for greater clarity.

The landing stage of FIG. 14D comprises a two-stage process. In the first stage, the frame 220 carrying the pump 234 is landed on the tree 200. The guide funnels 230 of the frame receive the guide legs 210 of the tree 200 to provide a first, relatively coarse alignment. The John Brown legs 232 of the frame engage the John Brown feet 208 of the tree 200 to provide amore precise alignment.

In the second stage, the piping interface 240 is brought into engagement with the secondary conduit 250 and the clamp 260 is applied to fix the connection. The two-stage connection process provides protection of the mating surfaces of the secondary conduit 250 and the piping interface 240, and it also protects the choke 204; particularly the mating surface of the choke 204. Instead of landing the frame and connecting the piping interface 240 and secondary conduit in a single movement, which could damage the connection between the piping interface 240 and the secondary conduit 250 and which could also damage the choke 204, the two-stage connection facilitates a controlled, buffered connection.

The piping interface 240 being suspended on the curved flexible conduits 236, 238 allows the piping interface 240 to move in all three spatial dimensions; hence the flexible conduits 236, 238 provide a resilient suspension for the piping interface on the pump 234. If the piping interface 240 is not initially accurately aligned with the secondary conduit 250, the resilience of the flexible conduits 236, 238 allows the piping interface 240 to deflect laterally, instead of damaging the mating surfaces of the piping interface 240 and the secondary conduit 250. Hence, the flexible conduits 236, 238 provide a buffering means to protect the mating surfaces.

Figure 16:
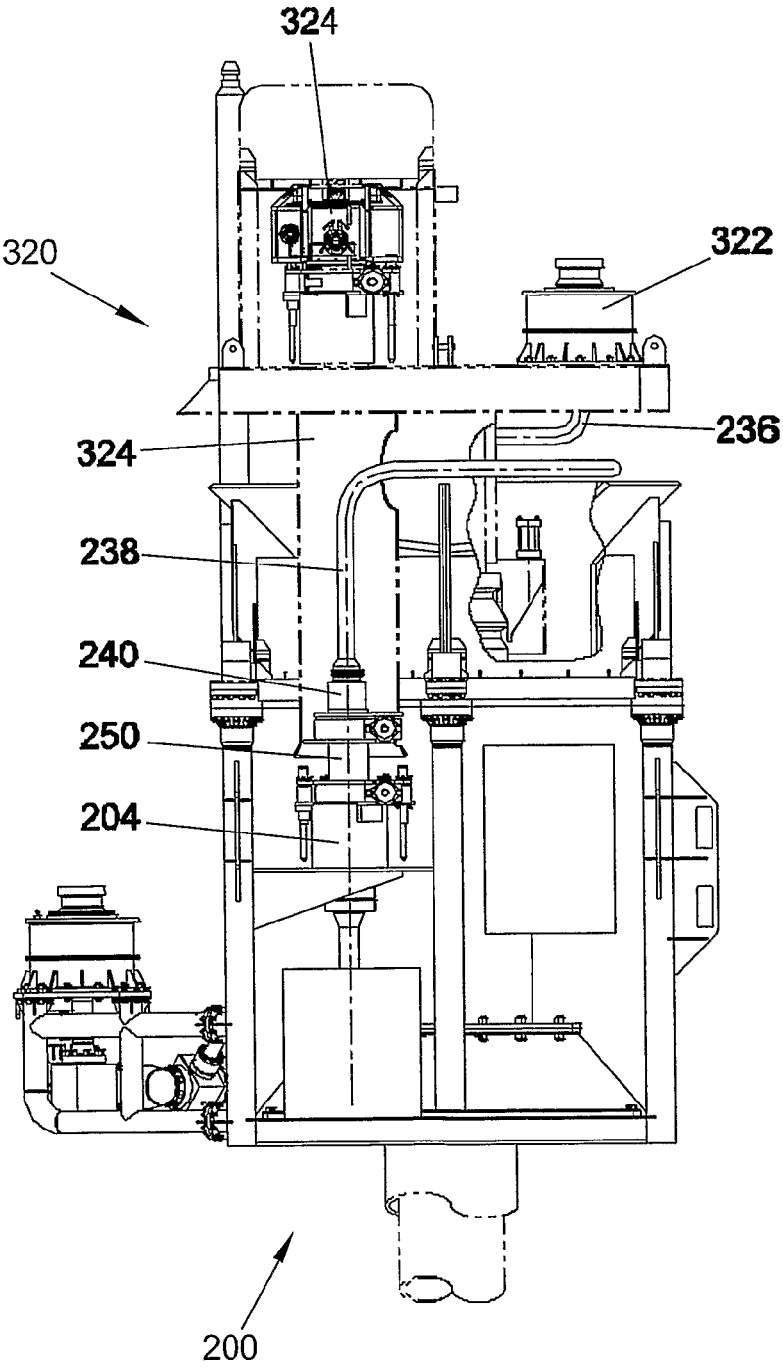
FIG. 16 shows a side view of an embodiment similar to that of FIG. 11, the frame also supporting a replacement choke.

A slightly modified version of the third embodiment is shown in FIG. 16. The piping interface 240, the secondary conduit 250 and the tree 200 are exactly the same as the FIG. 11 embodiment, and like parts are designated by like numbers. The piping interface 240 and the secondary conduit 250 are installed on the tree as described for the FIG. 11 embodiment.

However, in contrast with the FIG. 15 embodiment, the FIG. 16 embodiment comprises a frame 320 that does not carry a pump. Instead, the frame 320 is provided with two flow hubs 322 (only one shown) that are connected to respective jumpers leading to a processing apparatus remote from the tree. This connection is typically done as a final step, after the frame has landed on the tree and the connection between the piping interface 240 and the secondary conduit 250 has been made up. The processing apparatus could be a pump installed on a further subsea structure, for example a suction pile. A replacement choke 324 is also provided on the frame, which replaces the choke that has been removed from the choke body 204 to allow for insertion of the inner member 254 of the secondary conduit 250 into the choke body 204.

The replacement choke 324 is connected to one of the hubs 322 and to one of the flexible conduits 236, 238. The other of the flexible conduits 236, 238 is connected to the other hub 322.

The FIG. 16 frame is provided with a guide pipe 324 that extends perpendicularly to the plane of the frame 320. The guide pipe 324 has a hollow bore and extends downwards from the frame 320, surrounding the piping interface 240 and the vertical portion of at least one (and optionally both) of the flexible conduits 236, 238; the guide pipe 324 has a lateral aperture to allow the conduits 236, 238 to enter the bore. The guide pipe 324 thus provides a guide for the piping interface 240 which protects it from damage from accidental impact with the tree 200, since if the frame 320 is misaligned, the guide pipe 324 with impact the tree frame, instead of the piping interface 240. In an alternative embodiment, the guide pipe 324 could be replaced by guide members such as the guide funnels and John Brown legs of the FIG. 11 embodiment. In further embodiments, both the guide pipe 324 and these further guide members may be provided.

In use, the well fluids flow through the choke body 240, through the annuli 258, 248, through flexible conduit 238 into one of the hubs 322, through a first jumper conduit, through the processing apparatus (e.g. a pump) through a second jumper conduit, through the other of the hubs 322, through the replacement choke 324, through the flexible conduit 236 through the bores 246, 256 and to the production wing outlet 206. Alternatively, the flow direction could be reversed to inject fluids into the well.

A further alternative embodiment is shown in FIG. 17. This embodiment is very similar to the FIG. 16 embodiment, and like parts are designated with like numbers. In the FIG. 17 embodiment, the second hub 322 is also shown. In this embodiment, the guide pipe 324 surrounds only the flexible conduit 238, the other flexible conduit 236 only entering the guide pipe at the connection to the piping interface 240.

The principal difference between the embodiments of FIGS. 17 and 16 is the provision of an actuating means, which connects the flexible conduit 238 to the frame to control the movement of the flexible conduit 238 and hence the position of the piping interface 240. The actuating means has the form of a hydraulic cylinder, more specifically, a swivel eye mounting hydraulic cylinder 326. The hydraulic cylinder 326 comprises two spherical joints, which allow the lower end of the hydraulic cylinder to swing in a plane parallel to the plane of the frame 320 (the X-Y plane of FIG. 17). The spherical joints typically comprise spherical eye bushes. The swivel joints typically allow rotation of the hydraulic cylinder around its longitudinal axis by a total of approximately 180 degrees. The swivel joints also typically allow a swing of plus or minus ten degrees in both the X and Y directions. Hence, the hydraulic cylinder 326 does not fix the position of the flexible conduit 238 rigidly with respect to the frame 320, and does not impede the flexible conduit 238 from allowing the piping interface 240 to move in all three dimensions.

FIG. 17A shows the hydraulic cylinder 236 in a retracted position for landing the frame 320 on the tree 200 or for removing the frame 320 from the tree 200. In this retracted position, the flexible conduit 238 holds the piping interface 240 above the secondary conduit 250 so that it cannot engage or impact with the secondary 250 during landing.

To make up the connection between the piping interface 240 and the secondary conduit 250, the hydraulic cylinder is extended; the extended position is shown in FIG. 17B. In the extended position, the piping interface 240 now engages the secondary conduit 250. The pressure in the hydraulic cylinder 326 is now released to allow the clamp 260 to be actuated. The clamp 260 is actuated by an ROV, and pulls the piping interface 240 into even closer contact with the secondary conduit 250 to hold these components firmly together.

This invention has significant advantages. In the first embodiment, the lower frame member and mandrel are much lighter in weight and less bulky than the upper frame member and pump assembly. Consequently, it is easier to guide the mandrel into engagement with the choke body than it would be if the entire assembly were joined together and lowered as one unit. Once the lower frame member is installed, the upper frame member and pump assembly can be lowered with a lesser chance of damage to the subsea equipment. The upper end of the mandrel is rugged and strong enough to withstand accidental impact by the upper frame member. The two-step process thus makes installation much easier. The optional guide members further provide fine alignment to avoid damage to seating surfaces.

The movable upper and lower frame members of the mounting system of the second embodiment avoid damage to the seating surfaces of the mandrel and the receptacle.

While the invention has been shown in only a few of its forms, it should be apparent to those skilled in the art that it is not so limited but is susceptible to various changes without departing from the scope of the invention. For example, although shown in connection with a subsea tree assembly, the mounting apparatus could be installed on other subsea structures, such as a manifold or gathering assembly. Also, the flow interface device mounted to the upper frame member could be a compressor for compressing gas, a flow meter for measuring the flow rate of the subsea well, or some other device.

In the third embodiment, protection of the connection between the piping interface 240 and the secondary conduit 250 is achieved by the two-step connection process. Additional buffering is provided by the flexible conduits 236, 238, which allow resilient support of the piping interface 240 relative to the pump/the frame, allowing the piping interface 240 to move in all three dimensions. In some embodiments, even greater control and buffering are achieved using an actuation means to more precisely control the location of the piping interface 240 and its connection with the secondary conduit 250.

Improvements and modifications can be incorporated without departing from the scope of the invention. For example, it should be noted that the arrangement of the flowpaths in FIGS. 11 to 17 are just one example configuration and that alternative arrangements could be made. For example, in FIG. 16, the replacement choke could be located in the flowpaths before the first flow hub, so that the fluids pass through the choke before being diverted to the remote processing apparatus. The replacement choke could be located at any suitable point in the flowpaths.

Furthermore, in all embodiments, the flowpaths may be reversed, to allow both recovery and injection of fluids. In the third embodiment, the flow directions in the flexible conduits 236, 238 (and in the rest of the apparatus) would be reversed.

A replacement choke 324 could also be used in the other embodiments, as described for the FIG. 16 embodiment. The replacement choke 234 need not be provided on the frame.

All embodiments of the invention could be provided with a guide pipe, such as that shown in FIG. 16.

In alternative embodiments, the actuating means of FIG. 17 is not necessarily a swivel eye mounting hydraulic cylinder 326. In other embodiments, the hydraulic cylinder may only have a single swivelable connection, and in other embodiments, the hydraulic cylinder could have a reduced or even almost no range of movement in the X-Y plane. In further embodiments, this hydraulic cylinder could be replaced by a simple cable in the form of a string, which is attached to a part of the flexible conduit 238. The flexible conduit 238 could then simply be raised and lowered as desired by pulling and releasing the tension in the cable. In a further embodiment, the hydraulic cylinder could be replaced by a screw jack, also known as a power jack, a first screw member of the screw jack being attached to the frame, and a second screw member being coupled to the flexible conduit 238. Operating the screw jack also raises and lowers the end of the conduit means, as desired.

Although the above disclosures principally refer to the production wing branch and the production choke, the invention could equally be applied to a choke body of the annulus wing branch.

In the FIG. 11 embodiment, either of the conduits 236, 238 could be attached to the inlet and the outlet of the pump 234 and either may be attached to the inlet and the outlet of the piping interface 240.

Many different types of processing apparatus could be used. Typically, the processing apparatus comprises at least one of: a pump; a process fluid turbine; injection apparatus; chemical injection apparatus; a fluid riser; measurement apparatus; temperature measurement apparatus; flow rate measurement apparatus; constitution measurement apparatus; consistency measurement apparatus; gas separation apparatus; water separation apparatus; solids separation apparatus; and hydrocarbon separation apparatus.

The processing apparatus could comprise a pump or process fluid turbine, for boosting the pressure of the fluid. Alternatively, or additionally, the processing apparatus could inject gas, steam, sea water, drill cuttings or waste material into the fluids. The injection of gas could be advantageous, as it would give the fluids "lift", making them easier to pump. The addition of steam has the effect of adding energy to the fluids.

Injecting sea water into a well could be useful to boost the formation pressure for recovery of hydrocarbons from the well, and to maintain the pressure in the underground formation against collapse. Also, injecting waste gases or drill cuttings etc into a well obviates the need to dispose of these at the surface, which can prove expensive and environmentally damaging.

The processing apparatus could also enable chemicals to be added to the fluids, e.g. viscosity moderators, which thin out the fluids, making them easier to pump, or pipe skin friction moderators, which minimise the friction between the fluids and the pipes. Further examples of chemicals which could be injected are surfactants, refrigerants, and well fracturing chemicals. The processing apparatus could also comprise injection water electrolysis equipment.

The processing apparatus could also comprise a fluid riser, which could provide an alternative route between the well bore and the surface. This could be very useful if, for example, the flowline 206 becomes blocked.

Alternatively, processing apparatus could comprise separation equipment e.g. for separating gas, water, sand/debris and/or hydrocarbons. The separated component(s) could be siphoned off via one or more additional process conduits.

The processing apparatus could alternatively or additionally include measurement apparatus, e.g. for measuring the temperature/flow rate/constitution/consistency, etc. The temperature could then be compared to temperature readings taken from the bottom of the well to calculate the temperature change in produced fluids. Furthermore, the processing apparatus could include injection water electrolysis equipment.

The invention claimed is:

1. An assembly for injecting fluids into a subea well having a flow bore extending through a tree and into the well, the tree including a lateral branch with a branch bore communicating with the flow bore, the assembly comprising:

a choke body mounted on the lateral branch of the tree and communicating with the well flow bore, the choke body having fluid communication with a processing apparatus; and a single path injection flowpath extending from the processing apparatus through the choke body and into the branch bore to inject fluids into the well flow bore.

2. The assembly of claim 1 wherein the fluids include water from the sea.

3. The assembly of claim 1 wherein the fluids are chemicals.

4. The flow diverter assembly of claim 1 wherein the processing apparatus is selected from the group consisting of at least one of a pump, process fluid turbine, injection apparatus, chemical injection apparatus, fluid riser, measurement apparatus, temperature measurement apparatus, flow rate measurement apparatus, constitution measurement apparatus, consistency measurement apparatus, gas separation apparatus, water separation apparatus, solids separation apparatus, water electrolysis apparatus, and hydrocarbon separation apparatus.

5. The assembly of claim 1 wherein the processing apparatus is a chemical injection apparatus.

6. The assembly of claim 1 wherein the processing apparatus communicates with one end of a mandrel and the mandrel having another end connected to a connector on the choke body.

7. The assembly of claim 1 further including a conduit extending between the processing apparatus and a manifold connected to a connector on the choke body.

8. An assembly for injecting chemicals into a well having a flow bore extending through a tree and into the well, the tree including a lateral branch with a branch bore communicating with the flow bore, the assembly comprising:

a chemical injection apparatus communicating via a conduit with the branch bore; and a single path injection flowpath extending from the chemical injection apparatus through the conduit and into the branch bore and well flow bore to inject chemicals into the well flow bore;

wherein the branch bore includes an outlet connected to a flowline, the outlet being closed during injection.

9. The assembly of claim 8 further including a closure member to close the outlet.

10. An assembly for injection of fluids into a well having a flow bore extending through a tree and into the well, comprising:

a branch on the tree, the branch communicating with the flow bore and having an outlet and the branch including a port through a wall thereof;

a conduit communicating with the port to form a single path injection flowpath extending from an apparatus and through the wall of the branch and into the flow bore to inject into the flow bore; and a closure member for opening and closing the outlet of the branch; wherein the fluids are chemicals.

11. An assembly for injection of fluids into a well having a flow bore extending through a tree and into the well, comprising:

a branch on the tree, the branch communicating with the flow bore and having an outlet and the branch including a port through a wall thereof;

a conduit communicating with the port to form a single path injection flowpath extending from an apparatus and through the wall of the branch and into the flow bore to inject into the flow bore; and a closure member for opening and closing the outlet of the branch;

wherein the apparatus is selected from the group consisting of at least one of a pump, process fluid turbine, injection apparatus, chemical injection apparatus, fluid riser, measurement apparatus, temperature measurement apparatus, flow rate measurement apparatus, constitution measurement apparatus, consistency measurement apparatus, gas separation apparatus, water separation apparatus, solids separation apparatus, water electrolysis apparatus, and hydrocarbon separation apparatus.

12. An assembly for injection of fluids into a well having a flow bore extending through a tree and into the well, comprising:

a branch on the tree, the branch communicating with the flow bore and having an outlet and the branch including a port through a wall thereof;

a conduit communicating with the port to form a single path injection flowpath extending from an apparatus and through the wail of the branch and into the flow bore to inject into the flow bore; and a closure member for opening and closing the outlet of the branch;

wherein the apparatus is a chemical injection apparatus.

* * * * *